US006998902B2

(12) United States Patent
Sugimura

(10) Patent No.: US 6,998,902 B2
(45) Date of Patent: Feb. 14, 2006

(54) BANDGAP REFERENCE VOLTAGE CIRCUIT

(75) Inventor: Naoaki Sugimura, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/253,483

(22) Filed: Sep. 25, 2002

(65) Prior Publication Data

US 2003/0080806 A1 May 1, 2003

(30) Foreign Application Priority Data

Oct. 26, 2001 (JP) ..... 2001-328925

(51) Int. Cl.
*G05F 1/10* (2006.01)

(52) U.S. Cl. ..... 327/539; 327/540; 327/541; 323/313

(58) Field of Classification Search ..... 327/538, 327/539, 540, 541, 542, 543; 323/313
See application file for complete search history.

(56) References Cited

U.S. PATENT DOCUMENTS

| | | | | |
|---|---|---|---|---|
| 5,087,830 A * | 2/1992 | Cave et al. | 327/539 |
| 5,912,580 A * | 6/1999 | Kimura | 327/530 |
| 5,955,873 A * | 9/1999 | Maccarrone et al. | 323/314 |
| 6,002,243 A * | 12/1999 | Marshall | 323/313 |
| 6,191,644 B1 * | 2/2001 | Srinath et al. | 327/539 |
| 6,501,299 B2 * | 12/2002 | Kim et al. | 326/83 |
| 6,525,598 B1 * | 2/2003 | Croman | 327/543 |
| 6,570,437 B2 * | 5/2003 | Park et al. | 327/539 |
| 2002/0050854 A1 * | 5/2002 | Zha et al. | 327/539 |
| 2002/0125937 A1 * | 9/2002 | Park et al. | 327/539 |

FOREIGN PATENT DOCUMENTS

| | | | |
|---|---|---|---|
| EP | 0 930 619 A2 | | 7/1999 |
| JP | 03-269709 | * | 12/1991 |
| JP | 08-339232 | * | 12/1996 |
| JP | 09-237127 | * | 9/1997 |
| JP | 11-032494 | * | 12/1998 |
| JP | 11-231948 | | 8/1999 |
| JP | 2000-181554 | * | 6/2000 |
| JP | 2000-267749 | * | 9/2000 |
| JP | 2000-339962 | * | 12/2000 |

* cited by examiner

*Primary Examiner*—Terry D. Cunningham
(74) *Attorney, Agent, or Firm*—Volentine Francos & Whitt, PLLC

(57) ABSTRACT

A bandgap reference voltage circuit includes a constant-current circuit, a reference voltage output circuit generating a reference voltage according to the constant current, a power supply voltage detection circuit, and a start-up output circuit. The start-up output circuit supplies a starting potential to the constant-current circuit until the power supply voltage detection circuit detects that the power supply has reached a voltage sufficient for the constant-current circuit to maintain operation. The power supply voltage detection circuit has elements analogous to the elements in the constant-current circuit that determine this voltage, so start-up operation can occur and end reliably. The start-up output circuit includes a low-impedance path from the power supply to a node controlling supply of the starting potential, so power-supply noise does not trigger unwanted output of the starting potential after start-up operation has ended.

9 Claims, 21 Drawing Sheets

BANDGAP REFERENCE VOLTAGE CIRCUIT

BACKGROUND OF THE INVENTION

1. Field of the Invention

The present invention relates to a circuit for generating a reference voltage, more particularly to a bandgap reference voltage circuit.

2. Description of the Related Art

Bandgap reference voltage circuits are widely used because of their ability to generate a reference voltage that does not vary with temperature. FIG. 21 shows a bandgap reference voltage circuit described in, for example, Japanese Unexamined Patent Application Publication No. 11-231948. The circuit includes a reference stage 50 that generates a constant current proportional to a thermal voltage and generates the bandgap reference voltage from the constant current, a pair of start-up circuits 60A, 60B that start the reference stage 50 when power is initially applied, and a pair of filters 70A, 70B that filter the high power supply Vcc and lower power supply Vss.

During operation, p-channel transistors P500, P502, P508 form a first current mirror stage in the reference stage 50, p-channel transistors P504, P506, P509 form a second cascoded current mirror stage, and n-channel transistors N500, N502 also form a current mirror. All of these transistors operate in their saturation regions, due to the connections of their gate electrodes to nodes 517, 518, and 519. Resistor R500 enables the saturation state to be reached at a relatively low power-supply voltage. The current mirrors hold the currents on paths 512, 514, 516 to constant values determined by the sizes of bipolar transistors Q500 and Q502 and the value of resistor R502. The value of resistor R504 and the base-emitter voltage of bipolar transistor Q504 then establish a reference voltage Vref at node 510, which is held by capacitor C500 and made available to external circuits (not shown).

To generate the reference voltage Vref, it is necessary to initiate current flow on paths 512, 514, and 516, but the reference stage 50 is incapable of doing this by itself. The reason is basically that paths 512, 514, and 516 will not conduct until electrons have been supplied to or removed from the gates of transistors P500–P509, N500, and N502, but electrons cannot be supplied and removed via paths 512, 514, 516 until these paths conduct. This dilemma is overcome by having the first start-up circuit 60A draw electrons from the gates of transistors N500 and N502, and the second start-up circuit 60B supply electrons to the gates of transistors P500–P509. The start-up operation begins and ends as follows.

When the bandgap reference voltage circuit in FIG. 21 is initially powered up and the high power supply voltage Vcc rises, p-channel transistors P512 and P514 promptly turn on and supply Vcc to node 518, thereby turning on n-channel transistors N500 and N502. Since node 522 is initially at the low power supply voltage Vss, p-channel transistor P526 and n-channel transistor N508 turn on, supplying Vss to node 519 and turning on p-channel transistors P500, P502, and P508. Node 517 is also pulled down to the Vss level through resistor R500, turning on p-channel transistors P504, P506, and P509. Current can now flow on paths 512, 514, and 516, and a reference voltage Vref is generated.

When p-channel transistors P500–P509 turn on, p-channel transistors P516 and P518 in start-up circuit 60A also turn on, thereby supplying current to a disable node 520 and charging a connected capacitor C502. When the voltage at disable node 520 reaches such a level that the source-to-gate voltage of transistor P512 no longer exceeds the threshold voltage, transistor P512 turns off, ending the pulling up of node 518.

Similarly, as Vcc rises, p-channel transistors P522 and P524 in the second start-up circuit 60B turn on, supplying current to another disable node 522 and charging a connected capacitor C504, while n-channel transistor N504 remains off. When the voltage at disable node 522 reaches a predetermined level, p-channel transistor P526 turns off, n-channel transistor N506 turns on, and n-channel transistor N508 turns off, ending the pulling down of node 519. In addition, capacitor C506 charges and transistor P528 turns on, latching node 522 at the Vcc level.

During subsequent operation, node 518 is clamped at a potential equal to the sum of the base-emitter voltage (Vbe500) of bipolar transistor Q500 and the threshold voltage (Vtn500) of n-channel transistor N500. Transistor P520 remains turned off if the voltage at disable node 520 is less than the sum of this potential (Vbe500+Vtn500) and the threshold voltage (Vtp520) of transistor P520. Accordingly, the voltage at the disable node 520 is clamped at approximately Vbe500+Vtn500+Vtp520.

In this state, since transistors P516 and P518 are coupled to the first and second current mirror stages, they operate in their saturation regions, with high impedance. If the high power supply voltage Vcc varies, the variations are conducted to the source of transistor P512 through transistor P514, which remains in the on state, but the variations do not significantly affect disable node 520, because of the high impedance of transistors P516 and P518 and the cushioning effect of capacitor C502. As a result, the source-to-gate voltage of transistor P512 varies and may from time to time exceed the threshold voltage, so that transistor P512 turns on and supplies extra current to node 518. This extra current increases the gate-source bias of n-channel transistors N500 and N502, thereby increasing the current flow on paths 514 and 516, the biasing of p-channel transistors P500–P509, and the potential of node 510. If this behavior occurs repeatedly, due to periodic power-supply noise, for example, capacitor C500 gradually acquires additional charge and the bandgap reference voltage Vref drifts upward. Noise in the low power supply Vss can also cause Vref to drift.

The low-pass filters 70A, 70B in FIG. 21 are intended to solve this problem. By filtering Vcc, filter 70A reduces variations in the source potential of transistor P512 and prevents transistor P512 from turning on in synchronization with periodic noise.

The startup circuits 60A, 60B in FIG. 21 have problems other than noise, however. One problem is that, depending on the temperature characteristics of the circuit elements and the speed at which the high power supply Vcc rises when power is initially applied, the start-up operation (the pulling of nodes 518 and 519 up and down) may end too early or too late. If the start-up operation ends too early, before Vcc reaches the level necessary for constant current flow in the reference stage 50, the reference stage 50 may fail to start (fail to operate), in which case no bandgap reference voltage is generated. If the start-up operation continues too long after Vcc reaches the necessary level, the bandgap reference voltage may overshoot its intended value, and power is needlessly consumed.

Another problem is that transistors P516, P518, and P520 in start-up circuit 60A form a path through which unwanted current flows during steady-state operation.

Furthermore, the filters 70A, 70B in FIG. 21 fail to attack the root cause of the rise in the bandgap reference voltage due to power-supply noise, which is that during normal operation, disable node 520 is connected to the high power supply Vcc on a high-impedance path through transistors P516 and P518, and is held at a potential intermediate between the high power supply Vcc and the low power supply Vss, close to the switching point of p-channel transistor P520. These factors allow variations in the Vcc level to turn on transistor P512, as explained above.

Since filter 70A does not filter out low-frequency noise, it cannot completely prevent the periodic turning on of transistor P512. The reason is that transistors P516 and P518 and capacitor C502 combine with filter 70A to form an equivalent low-pass filter having a lower cut-off frequency than that of filter 70A alone. As a result, low-frequency power-supply noise that reaches the source of transistor P512 through filter 70A and transistor P514 may be cut off and fail to reach the gate of transistor P512. The consequent variations in the source-to-gate voltage of transistor P512 then turn on transistor P512, causing a gradual rise in the bandgap reference voltage Vref.

The bandgap reference voltage circuit shown in FIG. 21 thus lacks inherent immunity from power-supply noise. When power-supply noise with a frequency less than the cutoff frequency (fc) of filter 70A is present, the bandgap reference voltage may gradually increase, just as if filter 70A were absent.

The above problems of the bandgap reference voltage circuit in FIG. 21 arise from the use of the reference stage 50 to control the transistors P516, P518 and P520 that control the switching of start-up transistor P512.

SUMMARY OF THE INVENTION

An object of the present invention is to provide a bandgap reference voltage circuit that starts reliably, operates with reduced power consumption, and is highly immune to power-supply noise.

The invented bandgap reference voltage circuit includes a constant-current circuit, a reference voltage output circuit, a power supply voltage detection circuit, and a start-up output circuit.

The constant-current circuit receives a power supply and conducts a constant current proportional to a thermal voltage. The constant-current circuit has a starter node and includes first circuit elements defining a lower limit voltage, which is the lowest voltage of the power supply at which the constant-current circuit can operate.

The reference voltage output circuit generates a bandgap reference voltage according to the constant current generated by the constant-current circuit.

The power supply voltage detection circuit receives the power supply, and has second circuit elements similar to the first circuit elements in the constant-current circuit. By using the second circuit elements, the power supply voltage detection circuit detects whether the power supply has reached the lower limit voltage.

The start-up output circuit starts the constant-current circuit by supplying a starting potential to the starter node, typically pulling the starter node up or down, until the power supply reaches the lower limit voltage. Supply of the starting potential to the starter node then ceases, and the flow of current through the power supply voltage detection circuit is preferably shut off.

Providing the power supply voltage detection circuit with circuit elements similar to circuit elements in the constant-current circuit enables the power supply voltage detection circuit to detect with high reliability whether or not the power supply has reached the lower limit voltage and end the start-up operation at the proper time.

The start-up output circuit has a node that controls the supply of the starting potential to the starter node in the constant-current circuit. After the lower limit voltage has been reached, this node is preferably connected by a low-impedance path to the power supply, so that power-supply noise does not trigger the unwanted further supply of the starting potential to the starter node.

The constant-current circuit may include a negative feedback loop that reduces the dependence of the constant current on the voltage of the power supply.

DETAILED DESCRIPTION OF THE INVENTION

Figure 1:
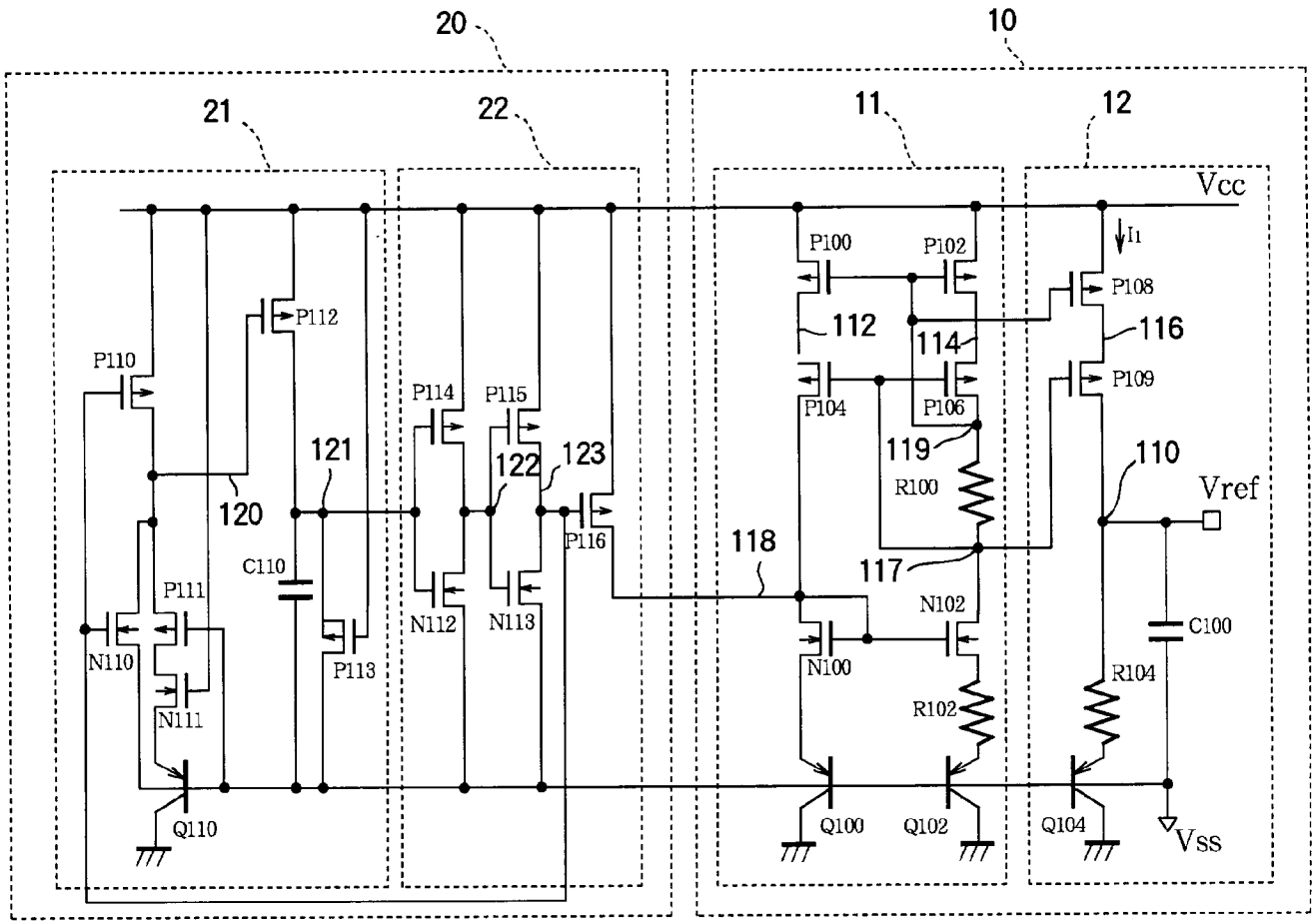
FIG. 1 is a circuit diagram of a bandgap reference voltage circuit illustrating a first embodiment of the invention.

Embodiments of the invention will now be described with reference to the attached drawings, in which like elements are indicated by like reference characters.

First Embodiment

FIG. 1 is a circuit diagram of a bandgap reference voltage circuit illustrating a first embodiment of the invention. This bandgap reference voltage circuit comprises a reference stage 10 and a start-up stage 20. The reference stage 10 generates a constant current proportional to a thermal voltage, and generates a bandgap reference voltage from the constant current. The start-up stage 20 starts the reference stage 10 when power is initially applied.

Structure of the Reference Stage 10

The reference stage 10 comprises a constant-current circuit 11 and a bandgap reference voltage output circuit 12. The constant-current circuit 11 generates a constant current $I_1$ proportional to a thermal voltage. The bandgap reference voltage output circuit 12 generates a bandgap reference voltage Vref from the constant current $I_1$.

The constant-current circuit 11 comprises a first pair of p-channel metal-oxide-semiconductor (MOS) transistors P100 and P102, a second pair of p-channel MOS transistors P104 and P106, and a third pair of n-channel MOS transistors N100 and N102. The sources of transistors P100 and P102 are coupled to the high power supply Vcc. The drain of transistor P100 is coupled to the source of transistor P104, and the drain of transistor P102 is coupled to the source of transistor P106. The drain of transistor P104 is coupled to the drain of transistor N100 at a starter node 118 to which the common gate of transistors N100 and N102 is also coupled. Transistors N100 and N102 have identical specifications, that is, identical dimensions and electrical characteristics.

The constant-current circuit 11 further comprises resistors R100 and R102 and pnp bipolar transistors Q100 and Q102. Resistor R100 is coupled between the drains of transistors P106 and N102. Transistor Q100 has an emitter coupled to the source of transistor N100, a base coupled to the low power supply Vss, and a collector coupled to the substrate. Resistor R102 is coupled between the source of transistor N102 and the emitter of transistor Q102, which has a base coupled to the low power supply Vss and a collector coupled to the substrate.

The bandgap reference voltage output circuit 12 comprises p-channel transistors P108 and P109, a resistor R104, and a pnp bipolar transistor Q104, which are connected in series, and a capacitor C100. The source of transistor P108 is coupled to the high power supply Vcc. The gate of transistor P108 is coupled to the gate of transistor P102, and the gate of transistor P109 is coupled to the gate of transistor P106. Transistor Q104 has a base coupled to the low power supply Vss, a collector coupled to the substrate, and an emitter coupled through resistor R104 to the drain of transistor P109. An output node 110 is disposed between the drain of transistor P109 and resistor R104. Capacitor C100 is coupled between the output node 110 and the low power supply Vss.

In the reference stage 10, transistors P100, P102, P104, P106, P108, and P109 have identical specifications. Transistors P100, P102, and P108 form a first current mirror stage, their gates being interconnected at node 119. Transistors P104, P106, and P109 form a second current mirror stage, their gates being interconnected at node 117. Due to these interconnections, the current on path 112 is mirrored by the currents on parallel paths 114 and 116. The first and second stages form a cascode current mirror circuit, in which the common gate of transistors P100, P102, and P108 is connected to the drain of transistor P106, and the common gate of transistors P104, P106, and P109 is coupled to the drain of transistor P106 through resistor R100.

Structure of the Start-Up Stage 20

The start-up stage 20 comprises a power supply voltage detection circuit 21 and a start-up output circuit 22. When power is turned on, as the high power supply voltage Vcc rises, the power supply voltage detection circuit 21 conducts current and thereby generates a signal indicating whether Vcc has reached a predetermined lower limit voltage. Until Vcc reaches this lower limit voltage, the start-up output circuit 22 pulls up node 118 in the constant-current circuit 11. After Vcc reaches the lower limit voltage, the start-up output circuit 22 stops pulling up node 118 and shuts off the flow of current in the power supply voltage detection circuit 21.

The power supply voltage detection circuit 21 comprises p-channel transistors P110 and P111, n-channel transistors N110 and N111, and a pnp bipolar transistor Q110. The source of transistor P110 is coupled to the high power supply Vcc. Transistors P111, N111, and Q110 are connected in series with transistor P110, the collector of transistor Q110 being grounded to the substrate. Transistor N110 is coupled between the low power supply Vss and a node 120, which is connected to the drain of transistor P110 and the source of transistor P111. The gate of transistor P111 is coupled to the low power supply Vss. The gate of transistor N111 is coupled to the high power supply Vcc. The base of transistor Q110 is coupled to the low power supply Vss.

The power supply voltage detection circuit 21 also comprises p-channel transistors P112 and P113 and a capacitor C110. Transistor P112 has a gate coupled to node 120 and a source coupled to the high power supply Vcc. Transistor P113 has a gate coupled to the high power supply Vcc, a source coupled to the drain of transistor P112 at a node 121, and a drain coupled to the low power supply Vss. Capacitor C110 is coupled between node 121 and the low power supply Vss. Node 121 functions as the output terminal of the power supply voltage detection circuit 21 and the input terminal of the start-up output circuit 22.

Transistors P111 and P112, transistor N111, and transistor Q110 in the power supply voltage detection circuit 21 have the same specifications as transistors P102 and P106, transistor N102, and transistor Q100, respectively, in the constant-current circuit 11.

The start-up output circuit 22 comprises p-channel transistors P114, P115, and P116 and n-channel transistors N112 and N113. Transistor P114 has a gate coupled to node 121 and a source coupled to the high power supply Vcc. Transistor N112 has a gate coupled to node 121 and a source coupled to the low power supply Vss. Transistor P115 has a gate coupled to a node 122, to which the drains of transistors P114 and N112 are coupled, and a source coupled to the high power supply Vcc. Transistor N113 has a gate coupled to node 122 and a source coupled to the low power supply Vss. Transistor P116 has a control input terminal or gate coupled to node 123, to which the drains of transistors P115 and N113 are coupled, a source coupled to the high power supply Vcc, and a drain coupled to the starter node 118. Transistor P116 operates as a start-up switching element that pulls up starter node 118. The voltage of node 123 is received by the gates of transistors P110 and N110 in the power supply voltage detection circuit 21.

Operation of the First Embodiment

The operation of the bandgap reference voltage circuit of the first embodiment shown in FIG. 1 will next be described. In this and subsequent descriptions, the following abbreviations will be used: Vbe means the base-emitter voltage of a pnp bipolar transistor; VDSsatp means the saturation source-drain voltage of a p-channel transistor; Vtp means the threshold voltage of a p-channel transistor; VDSsatn means the saturation source-drain voltage of an n-channel transistor; Vtn means the threshold voltage of an n-channel transistor. These abbreviations are followed by the corresponding reference numerals. For instance, the base-emitter voltage of pnp bipolar transistor Q100 is denoted Vbe100; the threshold voltage of p-channel transistor P100 is denoted Vtp100; the saturation source-drain voltage of n-channel transistor N100 is denoted VDSsatn100; the threshold voltage of n-channel transistor N100 is denoted Vtn100. A similar notation will be used for resistances (r), e.g., the resistance of resistor R100 is denoted r100.

Operation of the Reference Stage 10

The operation of the reference stage 10 will be described under the assumptions that: the high power supply Vcc has reached a voltage level sufficient for operating the constant-current circuit 11; the emitter area ratio (Q100:Q102) of transistors Q100 and Q102 is 1:N, where N is a positive number; and transistors Q100 and Q102 operate at collector current values in the diffusion region. Because the specifications of transistors P100, P102, P104, P106, P108, and P109 are the same, and the specifications of transistors N100 and N102 are the same, the constant current $I_1$ generated by the constant-current circuit 11, flowing through transistors P100 and P102, P104 and P106, and P108 and P109, is expressed as follows.

$$I_1=(1/r102)*K*(T/q)*\mathrm{LN}(N) \quad (1)$$

where K is the Boltzmann constant, T is absolute temperature, q is the charge of the electron, and LN(N) is the natural logarithm of the emitter area ratio N of transistors Q100 and Q102. Equation (1) ignores the power-supply dependence of the current $I_1$, due to the dependence of the drain currents of p-channel MOS transistors P100, P102, P104, P106, P108, and P109 and n-channel MOS transistors N100 and N102 on the drain voltage of these transistors (the effective channel-length modulation effect).

Given that transistor Q104 in the bandgap reference voltage output circuit 12 operates at a collector current value in the diffusion region, the voltage Vref at the output node 110 of the bandgap reference voltage output circuit 12 is expressed as follows:

$$Vref=Vbe104+(r104/r102)*K*(T/q)*\mathrm{LN}(N) \quad (2)$$

Voltage Vbe104 has a negative temperature coefficient. If the resistance ratio r104/r102 and the emitter area ratio N between transistors Q100 and Q102 are set so as to cancel out this temperature coefficient, the resultant bandgap reference voltage Vref becomes almost insensitive to variations in temperature. Like equation (1), equation (2) ignores the power supply dependence of the current $I_1$ due to the effective channel-length modulation effect.

The constant-current circuit 11 can generate a constant current $I_1$ only when all of its p-channel and n-channel transistors P100, P102, P104, P106, N100, and N102 operate in the saturation region. Therefore, the constant-current circuit 11 requires a high power supply voltage Vcc equal to or greater than the higher of the following two voltage levels: the lowest level (VCC1) of Vcc that enables transistors P100, P104, and N100 to operate in the saturation region on path 112; and the lowest level (VCC2) of Vcc that enables transistors P102, P106, and N102 to operate in the saturation region on path 114.

Voltage levels VCC1 and VCC2 are expressible as follows.

$$VCC1=Vbe100+VDSsatp100+VDSsatp104+Vtn100 \quad (3)$$

$$VCC2=Vbe102+I_1*r102+VDSsatn102+Vtp106+VDSsatp102=Vbe100+VDSsatn102+Vtp106+VDSsatp102 \quad (4)$$

Equation (4) assumes that the following two optimum design conditions are satisfied.

$$I_1*r100=VDSsatp102=VDSsatp106$$

$$Vtp106=Vtp102$$

In the first embodiment, it is assumed that VCC1 is equal to or less than VCC2.

During the period while the high power supply voltage Vcc is ramping up to the VCC2 level, the start-up stage 20 keeps node 118 pulled up to a voltage level sufficient to turn on transistors N100 and N102. When transistor N102 turns on, the potentials of nodes 117 and 119 are lowered, enabling the p-channel transistors in the cascode current mirror circuit to turn on. After the high power supply Vcc reaches voltage level VCC2, all of the MOS transistors on paths 112 and 114 have saturated, and the constant-current circuit 11 can maintain a constant current flow without the need for further assistance from the start-up stage 20.

Operation of the Start-Up Stage 20

Before power is initially applied, that is, while the high power supply voltage Vcc is 0 V, transistor P113 functions as a MOS diode and discharges capacitor C110. Accordingly, the voltage at node 121 does not exceed the threshold voltage Vtp113 of transistor P113.

As the high power supply Vcc rises, transistor P113 is held in the off state and the voltage level at node 121 remains at its original level, not exceeding the threshold voltage Vtp113 of transistor P113. This threshold voltage Vtp113 is set below the threshold voltage Vtn112 of transistor N112. As the high power supply Vcc increases, the voltage at the output node 122 of the inverter formed by transistors P114 and N112 goes high and increases together with Vcc. The voltage at the output node 123 of the inverter comprising transistors P115 and N113 therefore goes low. This low voltage is received at the gate of starter transistor P116 and the gates of transistors P110 and N110 in the power supply voltage detection circuit 21. Starter transistor P116 is turned on, pulling up starter node 118, while transistor N110 is turned off, and transistor P110 is turned on.

The start-up stage 20 is designed so that the sum of the saturation source-drain voltage of transistor N113 and the threshold voltage of transistor P110 (VDSsatn113+Vtp110) is lower than the sum of the saturation source-drain voltage of transistor P111, the saturation source-drain voltage of transistor N111, and the base-emitter voltage of transistor Q110 (VDSsatp111+VDSsatn111+Vbe110). Transistor P110 therefore turns on before transistors P111, N111, and Q110. The voltage at node 120, which is the drain voltage of transistor P110, remains approximately equal to the high power supply Vcc from when Vcc exceeds the VDSsatn113+Vtp110 level until Vcc exceeds the VDSsatp111+VDSsatn111+Vbe110 level. The potential at the gate of transistor P112 likewise remains approximately equal to the high power supply Vcc, so transistor P112 remains off.

When the high power supply Vcc exceeds the voltage level VDSsatp111+VDSsatn111+Vbe110, transistors P111, N111, and Q110 turn on, conducting current from the drain of transistor P110 and clamping node 120 at an approximately constant voltage (VDSsatp111+VDSsatn111+Vbe110). A voltage of (Vcc−(VDSsatp111+VDSsatn111+Vbe110)) is applied between the source and gate of transistor P112.

When the high power supply Vcc exceeds the sum of the saturation source-drain voltage of transistor P111, the saturation source-drain voltage of transistor N111, the base-emitter voltage of transistor Q110, and the threshold voltage of transistor P112 (VDSsatp111+VDSsatn111+Vbe110+Vtp112), transistor P112 is continuously turned on, conducts current, and starts charging capacitor C110. The voltage at node 121 rises in accordance with the time constant determined by the capacitance of capacitor C110.

When the voltage at node 121 reaches the switching threshold of the inverter formed by transistors P114 and N112, node 122 goes low, and the output node 123 of the inverter formed by transistors P115 and N113 goes high, completing the output of the single-shot pulse that started when output node 123 went low.

The low-to-high transition in the voltage level at node 123 turns off starter transistor P116, ending the pulling up of starter node 118. By this time, the voltage at starter node 118 has reached a level exceeding the sum of the source voltage of transistors N100 and N102 and their threshold voltage Vtn, so transistors N100 and N102 have turned on, the p-channel transistors in the cascode current mirror circuit have also turned on, and saturation current is flowing on paths 112, 114, and 116 in the reference stage 10.

If the high power supply Vcc rises slowly, the constant-current circuit 11 may be able to start operating without the need for capacitor C110. If Vcc rises rapidly, however, capacitor C110 is required in order to keep node 123 from going high before the start-up stage 20 can finish pulling up node 118 to the level necessary to start the constant-current circuit 11. Capacitor C110 ensures that the constant-current circuit 11 will start up reliably even if the high power supply Vcc reaches the VCC2 level instantaneously.

The low-to-high transition at node 123 also turns off transistor P110 and turns on transistor N110, latching node 120 at the low logic level. Transistor P112 is held in the on state, and node 121 is held at the high logic level.

In the first embodiment, the lower limit of the high power supply Vcc necessary for operation of the constant-current circuit 11 (the VCC2 value given in equation (4) as Vbe100+VDSsatn102+Vtp106+VDSsatp102) is defined by transistors P102, P106, N102, and Q100 in the constant-current circuit 11. The power supply voltage detection circuit 21 uses corresponding transistors P111, P112, N111, and Q110 to detect a voltage level (VDSsatp111+VDSsatn111+Vbe110+Vtp112) equal to the lower limit VCC2. Until the high power supply Vcc is detected to have reached this level, the start-up output circuit 22 keeps node 118 pulled up to a voltage level sufficient to turn on transistors N100 and N102 in the constant-current circuit 11. When the high power supply Vcc reaches the VCC2 voltage level (VDSsatp111+VDSsatn111+Vbe110+Vtp112), the pull-up operation is completed, and all current flow in the start-up stage 20 ends.

For transistors N100 and N102 to operate, the voltage at the starter node 118 must be at least Vbe100+Vtn100. The period needed for starter node 118 to reach this voltage level (Vbe100+Vtn100) coincides with the period needed for Vcc to reach the lower limit voltage level VCC2 (equal to VDSsatp111+VDSsatn111+Vbe110+Vtp112). During this period, starter transistor P116 keeps starter node 118 pulled up and transistors N100 and N102 turned on. After Vcc reaches the VCC2 level, starter transistor P116 is turned off and the constant-current circuit 11 maintains node 118 at the necessary level. Therefore, in the first embodiment, the constant-current circuit 11 can start correctly and generate a bandgap reference voltage Vref with high reliability, irrespective of the speed with which the high power supply Vcc rises or the temperature characteristics of the components of the power supply voltage detection circuit.

The bandgap reference voltage circuit in the first embodiment can generate a bandgap reference voltage Vref reliably if the constant-current circuit 11 is capable of operating alone when the high power supply Vcc is above VCC2, that is, if VCC2 is higher than VCC1 (if Vbe100+VDSsatn102+Vtp106+VDSsatp102>Vbc100+VDSsatp100+VDSsatp104+Vtn100). The first embodiment is accordingly applicable to devices fabricated by a process that makes (2*VDSsatp+Vtn)<(VDSsatn+Vtp+VDSsatp).

In the bandgap reference voltage circuit of the first embodiment, when the high power supply Vcc reaches the lower limit VCC2 (=VDSsatp111+VDSsatn111+Vbe110+Vtp112), transistor P112 turns on, and node 121 goes high. This turns on transistors N112 and P115 in the start-up output circuit 22, clamping node 122 low and node 123 high. Accordingly, transistor N110 in the power supply voltage detection circuit 21 is turned on, clamping node 120 low. Transistor P112 is therefore held securely in the on state, and the high power supply Vcc is conducted with low impedance to node 121. Transistor P115 is also held securely in the on state, and the high power supply Vcc is conducted with low impedance to node 123. Nodes 121 and 123 can therefore stay in phase with power-supply noise on the high power supply Vcc.

Initially, node 121 serves as the control input to the start-up output circuit 22, and node 123 controls the start-up operation of the constant-current circuit 11 performed by the start-up output circuit 22, by turning starter transistor P116 on and off. In the steady-state operation after the constant-current circuit 11 has started up, since nodes 121 and 123 stay in phase with power-supply noise, the source and gate voltages of starter transistor P116 can stay in phase, despite power-supply noise, so that transistor P116 is not turned on due to power-supply noise after the high power supply Vcc has reached the VCC2 level. Because the starter transistor P116 is held securely in the off state, the bandgap reference voltage will not gradually rise because of periodic power-supply noise.

In the bandgap reference voltage circuit of the first embodiment, when the high power supply Vcc reaches the VCC2 level (=VDSsatp111+VDSsatn111+Vbe110+Vtp112), transistor P112 is turned on, pulling up node 121 to the high level, thus turning on transistors N112 and P115 in the start-up output circuit 22 and clamping node 123 at the high level, so that transistor P110 in the power supply voltage detection circuit 21 is turned off and held in the off state. Therefore, in the steady-state operation after the constant-current circuit 11 has started up, there is no path on which unwanted current can flow through the start-up stage 20. As steady-state operation is thus free of unwanted current flow, power consumption is reduced.

First Variation of the First Embodiment

Figure 2:
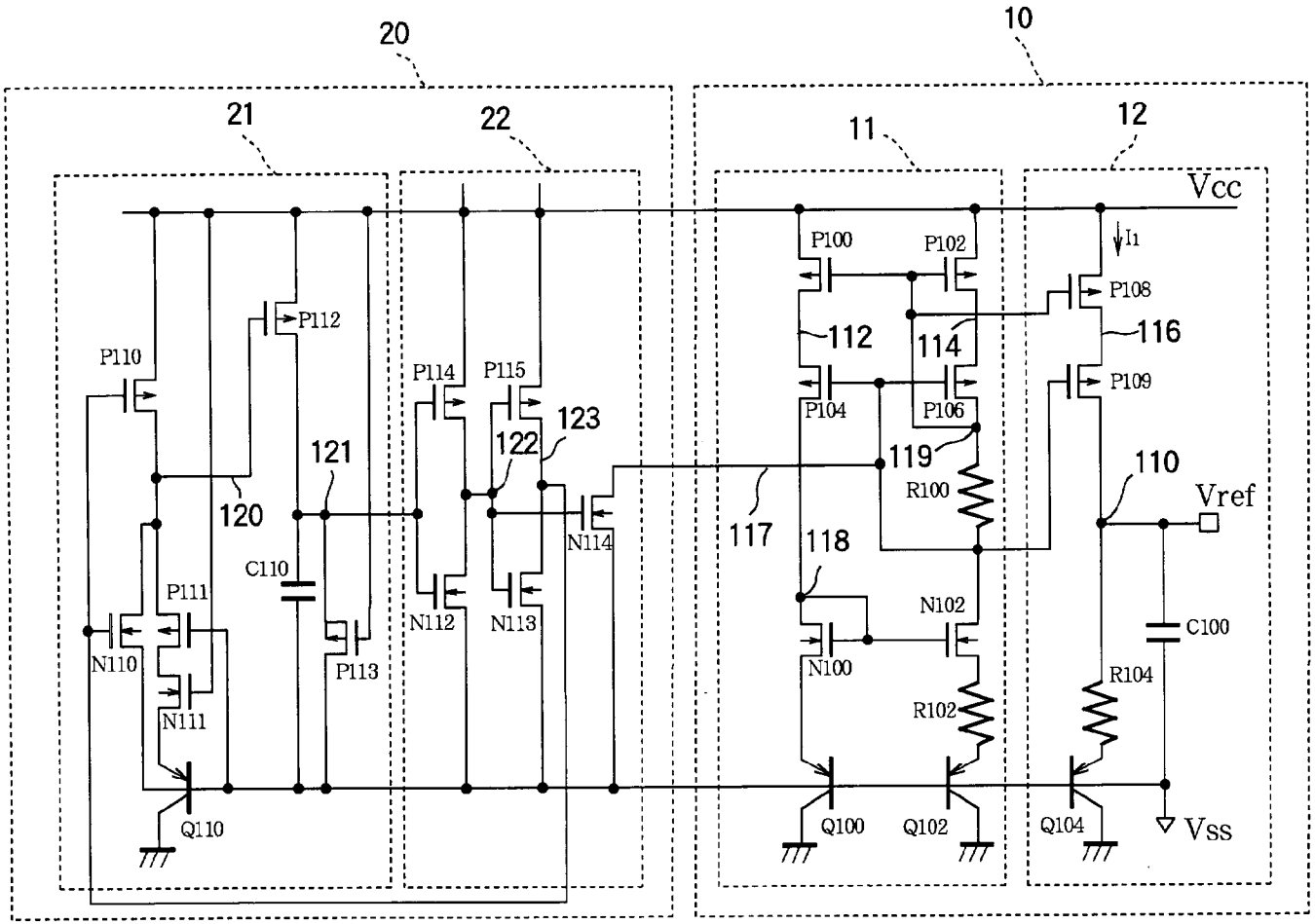
FIG. 2 is a circuit diagram of a bandgap reference voltage circuit illustrating a first variation of the first embodiment.

FIG. 2 is a circuit diagram of a bandgap reference voltage circuit illustrating a first variation of the first embodiment. In comparison with the circuit in FIG. 1, the reference stage 10 and power supply voltage detection circuit 21 have the same configuration, but the start-up output circuit 22 in the start-up stage 20 has a different configuration.

The start-up output circuit 22 in FIG. 2 differs from the start-up output circuit 22 in FIG. 1 in that the start-up transistor is an n-channel transistor N114, instead of a p-channel transistor. Transistor N114 has a gate coupled to node 122, a source coupled to the low power supply Vss, and a drain coupled to node 117, which is now the starter node in the constant-current circuit 11.

The start-up stage 20 of the first variation of the first embodiment starts the constant-current circuit 11 by keeping node 117 pulled down substantially from the time when power is initially applied until the high power supply Vcc reaches the VCC2 level value given by equation (4). This variation, like the first embodiment described above, is applicable if the constant-current circuit 11 can maintain constant-current operation when Vcc is higher than VCC2.

In the first embodiment, the common gate of n-channel transistors N100 and N102 in the constant-current circuit 11 is kept pulled up to the level of the high power supply Vcc until the high power supply Vcc reaches the VCC2 voltage level, so that transistors N100 and N102 turn on quickly, enabling the constant-current circuit 11 to start up.

In the first variation of the first embodiment, the common gate of p-channel transistors P104 and P106 is pulled down to the low power supply level Vss, and the common gate of transistors P100 and P102 is also pulled down to the Vss level through resistor R100. This forces the cascode current mirror circuit comprising p-channel transistors P100, P102, P104, and P106 to operate in a way that quickly brings node 118 to the level necessary for n-channel transistors N100 and N102 to turn on, so that the constant-current circuit 11 can start up. The first variation has substantially the same effects as the first embodiment.

Second Variation of the First Embodiment

Figure 3:
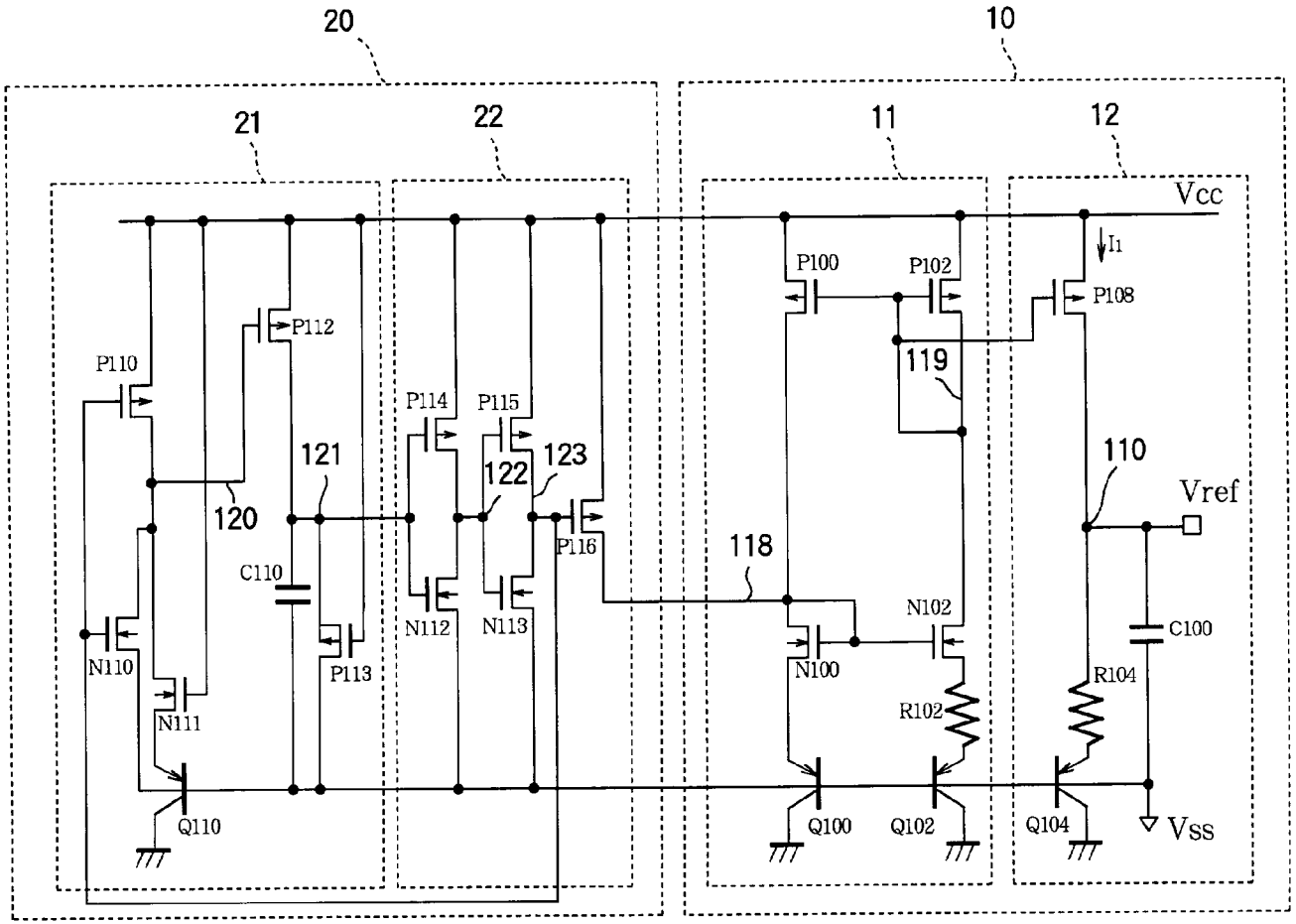
FIG. 3 is a circuit diagram of a bandgap reference voltage circuit illustrating a second variation of the first embodiment.

FIG. 3 is a circuit diagram of a bandgap reference voltage circuit illustrating a second variation of the first embodiment. In comparison with the first embodiment shown in FIG. 1, the start-up output circuit 22 in the start-up stage 20 has the same configuration while the reference stage 10 and the power supply voltage detection circuit 21 have different configurations.

Whereas the constant-current circuit 11 in the first embodiment had p-channel transistors connected in a cascode current mirror configuration, the second variation employs a simpler current mirror configuration. The constant-current circuit 11 in FIG. 3 differs from the constant-current circuit 11 in FIG. 1 in that transistors P104 and P106 and resistor R100 are eliminated. The bandgap reference voltage output circuit 12 in FIG. 3 differs from the bandgap reference voltage output circuit 12 in FIG. 1 in that transistor P109 is eliminated. The power supply voltage detection circuit 21 in FIG. 3 differs from the power supply voltage detection circuit 21 shown in FIG. 1 in that transistor P111 is eliminated.

In the second variation of the first embodiment, the start-up stage 20 keeps the common gate of n-channel transistors N100 and N102 in the constant-current circuit 11 pulled up to the high power supply Vcc until the high power supply Vcc reaches the sum of the saturation source-drain voltage of transistor N111, the base-emitter voltage of transistor Q110, and the threshold voltage of transistor P112 (VDSsatn111+Vbe110+Vtp112). The constant-current circuit 11 starts operating when the voltage at the common gate reaches a level sufficient to turn on transistors N100 and N102.

The second variation of the first embodiment is applicable if the bandgap reference voltage circuit is fabricated by a process such that (VDSsatp+Vtn)<(VDSsatn+Vtp). The constant-current circuit 11 can then maintain constant-current operation if the high power supply Vcc is at least the sum of the saturation source-drain voltage of transistor N102, the base-emitter voltage of transistor Q100, and the threshold voltage of transistor P102 (Vbe100+VDSsatn102+Vtp102). This is lower than the VCC2 value given by equation (4), making the second variation of the first embodiment useful for low-voltage applications.

Third Variation of the First Embodiment

Figure 4:
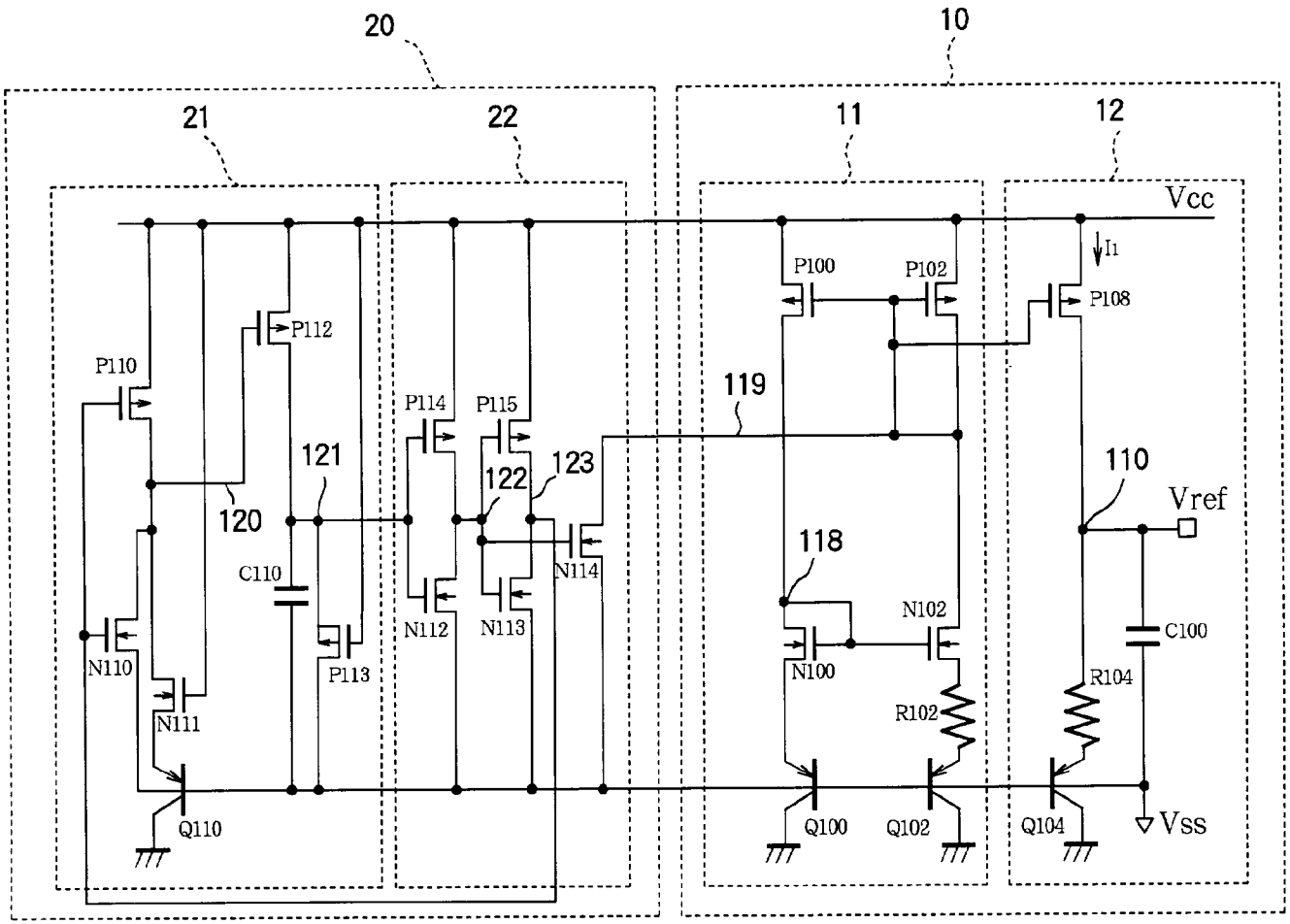
FIG. 4 is a circuit diagram of a bandgap reference voltage circuit illustrating a third variation of the first embodiment.

FIG. 4 is a circuit diagram of a bandgap reference voltage circuit illustrating a third variation of the first embodiment. The reference stage 10 and the power supply voltage detection circuit 21 of this circuit have the same configuration as in the second variation of the first embodiment, and the start-up output circuit 22 has the same configuration as in the first variation of the first embodiment. The drain of transistor N114 is coupled to a node 119 which functions as the starter node in the constant-current circuit 11.

In the bandgap reference voltage circuit of the third variation of the first embodiment, the common gate of p-channel transistors P100 and P102 is kept pulled down until the high power supply Vcc reaches the voltage level VDSsatn111+Vbe110+Vtp112. By this point transistors N100 and N102 have turned on and the constant-current circuit 11 can maintain constant-current operation on its own. This third variation has substantially the same effects as the second variation.

Second Embodiment

Figure 5:
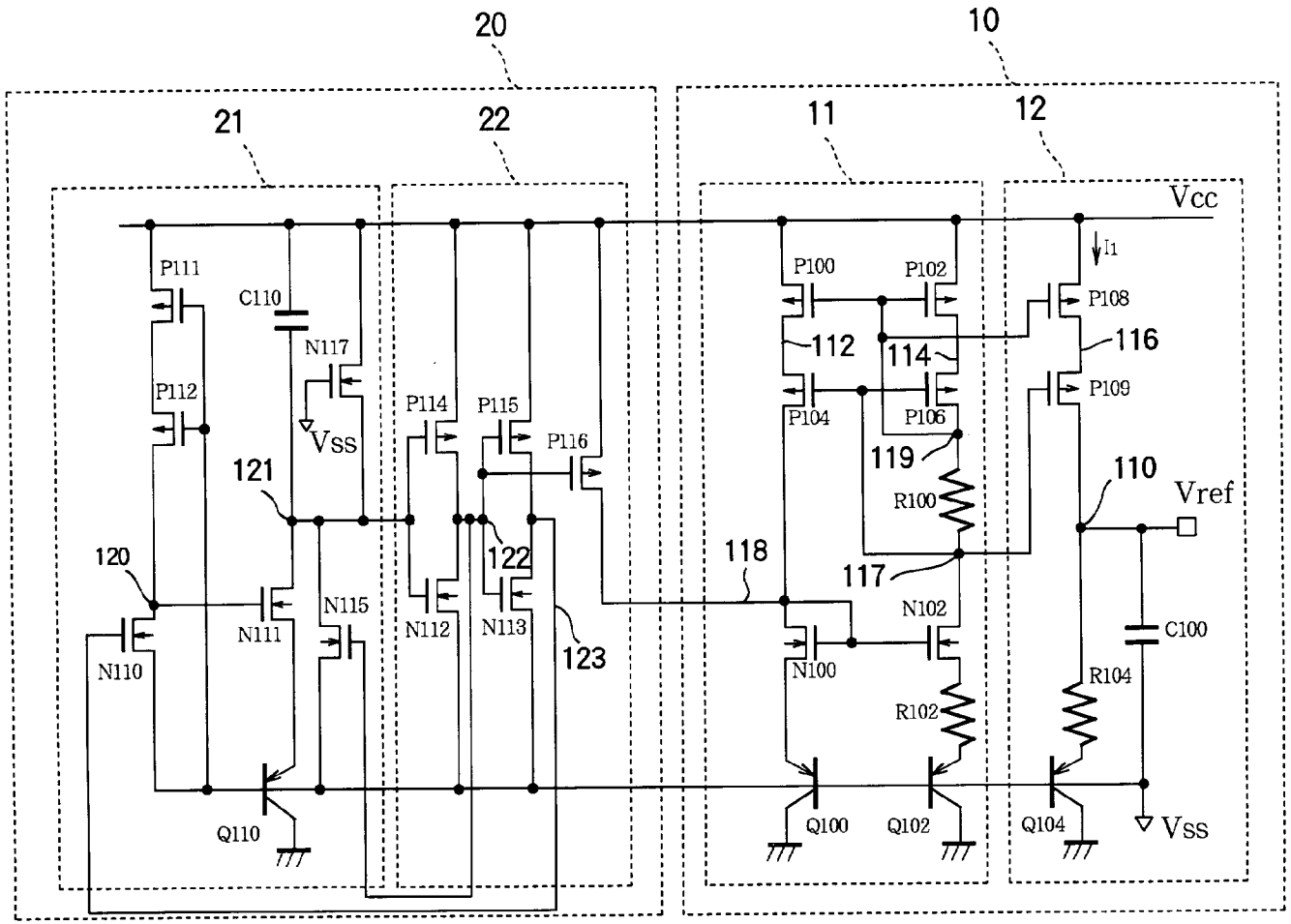
FIG. 5 is a circuit diagram of a bandgap reference voltage circuit illustrating a second embodiment of the invention.

FIG. 5 is a circuit diagram of a bandgap reference voltage circuit illustrating a second embodiment of the invention, this embodiment also comprising a reference stage 10 and a start-up stage 20. The reference stage 10 has the same configuration as in the first embodiment; the start-up stage 20 has a different configuration.

Structure of the Start-Up Stage 20

In the start-up stage 20 shown in FIG. 5, the power supply voltage detection circuit 21 comprises p-channel transistors P111 and P112 and n-channel transistor N110. The source of transistor N110 is coupled to the low power supply Vss. Transistors P111 and P112 are connected in series between the high power supply Vcc and node 120, which is coupled to the drain of transistor N110. The gates of transistors P111 and P112 are coupled to the low power supply Vss.

The power supply voltage detection circuit 21 in FIG. 5 also comprises n-channel transistors N111, N115, and N117, pnp bipolar transistor Q110, and capacitor C110. Transistor Q110 has a collector grounded to the substrate and a base coupled to the low power supply Vss. Transistor N111 has a source coupled to the emitter of transistor Q110 and a gate coupled to node 120. Transistor N117 has a gate coupled to the low power supply Vss, a source coupled to node 121, which is coupled to the drain of transistor N111, and a drain coupled to the high power supply Vcc. Transistor N115 is inserted between node 121 and the low power supply Vss. Capacitor C110 is coupled between the high power supply Vcc and node 121. Node 121 functions as the output terminal of the power supply voltage detection circuit 21 and the input terminal of the start-up output circuit 22.

Transistors P111 and P112, transistor N111, and transistor Q110 in the power supply voltage detection circuit 21 have the same specifications as transistors P100 and P104, transistor N100, and transistor Q100, respectively, in the constant-current circuit 11.

The start-up output circuit 22 in FIG. 5 comprises p-channel transistors P114, P115, and P116 and n-channel transistors N112 and N113. Transistor P114 has a gate coupled to node 121 and a source coupled to the high power supply Vcc. Transistor N112 has a gate coupled to node 121 and a source coupled to the low power supply Vss. Transistor P115 has a gate coupled to a node 122 to which the drains of transistors P114 and N112 are connected, and a source coupled to the high power supply Vcc. Transistor N113 has a gate coupled to node 122 and a source coupled to the low power supply Vss. Transistor P116 has a gate coupled to node 122, a source coupled to the high power supply Vcc, and a drain coupled to starter node 118, so that transistor P116 pulls up starter node 118. Node 122 is coupled to the gate of transistor N115 in the power supply voltage detection circuit 21, while the node 123 to which the drains of transistors P115 and N113 are connected is coupled to the gate of transistor N110 in the power supply voltage detection circuit 21.

The start-up output circuit 22 of the second embodiment differs from the start-up output circuit 22 of the first embodiment (see FIG. 1) in the following two regards: the gate of starter transistor P116 is coupled to node 122 instead of node 123; this node 122 is coupled to the power supply voltage detection circuit 21.

Operation of the Second Embodiment

The operation of the bandgap reference voltage circuit of the second embodiment shown in FIG. 5 will next be described. The reference stage 10 of the second embodiment shown in FIG. 5 operates in the same way as the reference stage 10 of the first embodiment (see FIG. 1).

In the second embodiment, as in the first embodiment, the start-up stage 20 is needed to bring the voltage at node 118 up to a level sufficient to turn on transistors N100 and N102 when power is initially supplied. The start-up stage 20 in the second embodiment keeps node 118 pulled up to this level until the high power supply Vcc reaches the voltage level VCC1 given in equation (3). The second embodiment is thus applicable when the minimum voltage that enables the constant-current circuit 11 to operate independently is VCC1; that is, when VCC1 is equal to or greater than the VCC2 value given by equation (4).

The operation of the start-up stage 20 in FIG. 5 will now be described. Before power is initially applied, that is, while the high power supply Vcc is 0 V, transistor N117 functions as a MOS diode and discharges capacitor C110. Accordingly, the difference between the voltage at node 121 and the high power supply Vcc does not exceed the threshold voltage Vtn117 of transistor N117.

The voltage level at node 121 increases as the high power supply Vcc rises. The threshold voltage Vtp114 of transistor P114 is set higher than the threshold voltage Vtn117 of transistor N117, so the voltage at the output node 122 of the inverter formed by transistors P114 and N112 goes low, and the voltage at the output node 123 of the inverter formed by transistors P115 and N113 goes high, rising with the high power supply Vcc. The low voltage at node 122 is received at the gate of transistor N115 in the start-up output circuit 22, and keeps transistor N115 turned off. The voltage at node 122 is also received at the gate of starter transistor P116, which is turned on and pulls up starter node 118.

When the high power supply Vcc exceeds the sum of the saturation source-drain voltage of transistor P115 and the threshold voltage of transistor N110 (VDSsatp115+Vtn110), transistor N110 turns on sufficiently for transistors P111 and P112 to operate as a MOS cascode circuit. The current capability of this MOS cascode circuit is set higher than the current capability of transistor N110; specifically, the saturation source-drain voltage VDSsatn110 of transistor N110 is set higher than the sum of the saturation source-drain voltage of transistor P111 and the saturation source-drain voltage of transistor P112 (VDSsatp111+VDSsatp112). The voltage at node 120, which is the drain voltage of transistor N110, is therefore clamped at a voltage level obtained by subtracting the saturation source-drain voltages of transistors P111 and P112 from the high power supply voltage (Vcc−(VDSsatp111+VDSsatp112)). The voltage at node 120 increases as Vcc rises.

When the high power supply Vcc reaches a level exceeding the sum of the saturation source-drain voltages of transistors P111 and P112, the base-emitter voltage of transistor Q110, and the threshold voltage of transistor N111 (VDSsatp111+VDSsatp112+Vbe110+Vtn112), transistor N111 turns on, conducts current, and starts charging capacitor C110. The voltage at node 121 falls in accordance with the time constant determined by the capacitance of capacitor C110.

When the voltage at node 121 decreases to the switching threshold of the inverter formed by transistors P114 and N112, node 122 goes high, and the output node 123 of the inverter formed by transistors P115 and N113 goes low. The output of the single-shot pulse that started when output node 123 went high is completed when output node 123 goes low.

The low-to-high transition at node 122 turns on transistor N115, while the high-to-low transition at node 123 turns off transistor N110. Node 120 is now clamped at the high logic level, and transistor N111 is fully turned on. With transistor N115 likewise turned on, node 121 is held at the low logic level.

Even when transistor N111 is fully turned on, it does not provide a low-impedance path between node 121 and the low power supply Vss, because this path also passes through transistor Q110. Once transistor N115 is turned on, however, the impedance between node 121 and the low power supply Vss becomes adequately low, as the path through transistor N115 bypasses transistor Q110.

The low-to-high transition in the voltage level at node 122 also turns off starter transistor P116, ending the pulling up of starter node 118. This completes the start-up operation that pulls the voltage at starter node 118 above the sum of the source voltage of transistors N100 and N102 and the threshold voltage Vtn as the supply voltage rises.

In the bandgap reference voltage circuit of the second embodiment, the lower limit of the high power supply Vcc necessary for operation of the constant-current circuit 11 (the VCC1 value given by equation (3) as Vbe100+VDSsatp100+VDSsatp104+Vtn100) is defined by transistors P100, P104, N100, and Q100 in the constant-current circuit 11. The power supply voltage detection circuit 21 uses corresponding transistors P111, P112, N111, and Q110 to detect a voltage level VDSsatp111+VDSsatp112+Vbe110+Vtn111, which is equal to the lower limit VCC1. Until the high power supply Vcc reaches the VCC1 level, the start-up output circuit 22 keeps node 118 pulled up to a voltage level sufficient to turn on transistors N100 and N102 in the constant-current circuit 11. When the high power supply Vcc reaches the VCC1 voltage level (VDSsatp111+VDSsatp112+Vbe110+Vtn11), the pull-up operation is completed, and all current flow in the start-up stage 20 ends.

Like the first embodiment, the second embodiment can start the constant-current circuit 11 and generate the bandgap reference voltage Vref with high reliability, irrespective of the speed with which the high power supply Vcc rises or the temperature characteristics of the components of the power supply voltage detection circuit. In addition, after the high power supply Vcc reaches the lower limit value VCC1, power consumption is reduced, and increases in the bandgap reference voltage Vref due to power-supply noise are prevented.

The bandgap reference voltage circuit of the second embodiment can generate a bandgap reference voltage Vref reliably if the lower limit of the high power supply Vcc necessary for operation of the constant-current circuit 11 is VCC1 (=Vbc100+VDSsatp100+VDSsatp104+Vtn100); that is, if a process is used that makes (2*VDSsatp+Vtn)> (VDSsatn+Vtp+VDSsatp), so that VCC1 is higher than VCC2 (=Vbe100+VDSsatn102+Vtp106+VDSsatp102).

In the bandgap reference voltage circuit of the second embodiment, when the high power supply Vcc reaches the lower limit VCC1 (=VDSsatp111+VDSsatp112+Vbe110+Vtn111), transistor N111 turns on, and the potential of node 121 starts to fall. Shortly thereafter, the transistors in the start-up output circuit 22 switch on/off states, node 122 goes high, and transistor N115 in the power supply voltage detection circuit 21 is held securely in the on state, establishing a low-impedance path between the low power supply Vss and node 121. Node 121 is thus held at the low logic level and transistor P114 is held securely in the on state, creating a low-impedance path between the high power supply Vcc and node 122.

Node 122, which controls the pull-up operation of starter node 118 by turning starter transistor P116 on and off, can therefore stay in phase with electrical noise in the high power supply Vcc. Because the source voltage and gate voltage of starter transistor P116 are both in phase with the power-supply noise, starter transistor P116 does not turn on due to power-supply noise after the high power supply Vcc reaches the lower limit level VCC1. Because the starter transistor P116 is held securely in the off state, the bandgap reference voltage will not gradually rise due to periodic power-supply noise.

In the steady-state operation after the high power supply Vcc has reached VCC1 (=VDSsatp111+VDSsatp112+Vbe110+Vtn111) and the constant-current circuit 11 has started up, nodes 120 and 122 are high, nodes 121 and 123 are low, and transistors P111, P112, P114, N111, N113, and N115 are turned on, but transistors P115, P116, N110, N112, and N117 are securely turned off. Therefore, there is no path on which current can flow through the start-up stage 20. The steady-state operation is thus free of unwanted current flow, and power consumption is reduced.

First Variation of the Second Embodiment

Figure 6:
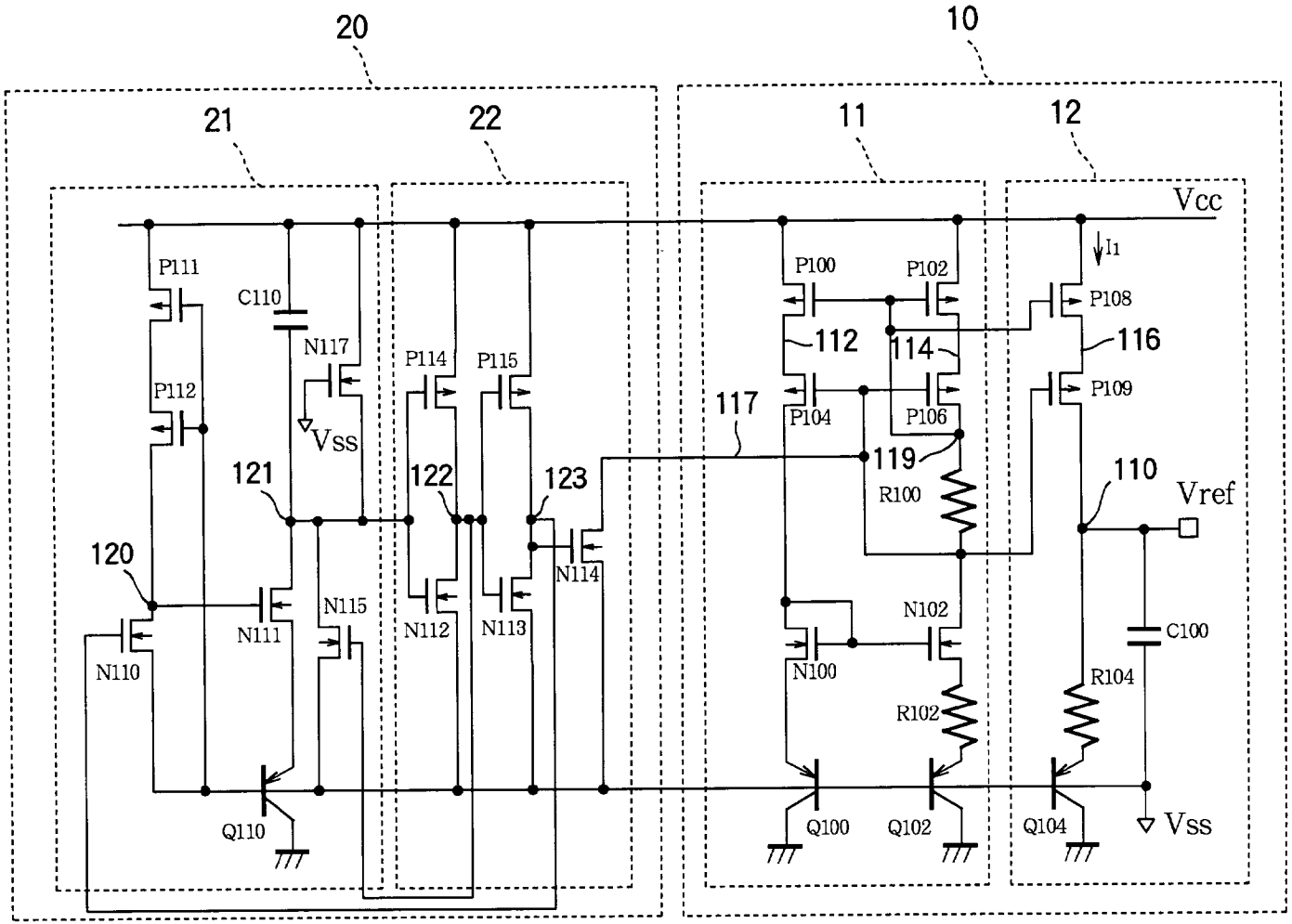
FIG. 6 is a circuit diagram of a bandgap reference voltage circuit illustrating a first variation of the second embodiment.

FIG. 6 is a circuit diagram of a bandgap reference voltage circuit illustrating a first variation of the second embodiment. In comparison with the circuit in FIG. 5, the reference stage 10 and the power supply voltage detection circuit 21 have the same configuration, but the start-up output circuit 22 in the start-up stage 20 has a different configuration.

The start-up output circuit 22 in FIG. 6 differs from the start-up output circuit 22 in FIG. 5 in that the start-up transistor is an n-channel transistor N114, instead of the p-channel transistor. Transistor N114 has a gate coupled to node 123, a source coupled to the low power supply Vss, and a drain coupled to node 117, which is now the starter node in the constant-current circuit 11.

The start-up stage 20 of the first variation of the second embodiment starts the constant-current circuit 11 by keeping node 117 pulled down until the high power supply Vcc reaches the VCC1 level value given by equation (3). This variation, like the second embodiment described above, is applicable if the constant-current circuit 11 can maintain constant-current operation when Vcc is higher than VCC1.

In the second embodiment, the common gate of n-channel transistors N100 and N102 in the constant-current circuit 11 is kept pulled up to the level of the high power supply Vcc until the high power supply Vcc reaches the VCC1 voltage, so that transistors N100 and N102 turn on quickly, enabling the constant-current circuit 11 to start up.

In the first variation of the second embodiment, the common gate of p-channel transistors P104 and P106 is pulled down to the low power supply Vss, and the common gate of p-channel transistors P100 and P102 is also pulled down to the low power supply Vss through resistor R100. This forces the cascode current mirror circuit comprising p-channel transistors P100, P102, P104, and P106 to operate in a way that quickly brings node 118 to the level necessary for n-channel transistors N100 and N102 to turn on, so that the constant-current circuit 11 can start up. The first variation has substantially the same effects as the second embodiment.

Second Variation of the Second Embodiment

Figure 7:
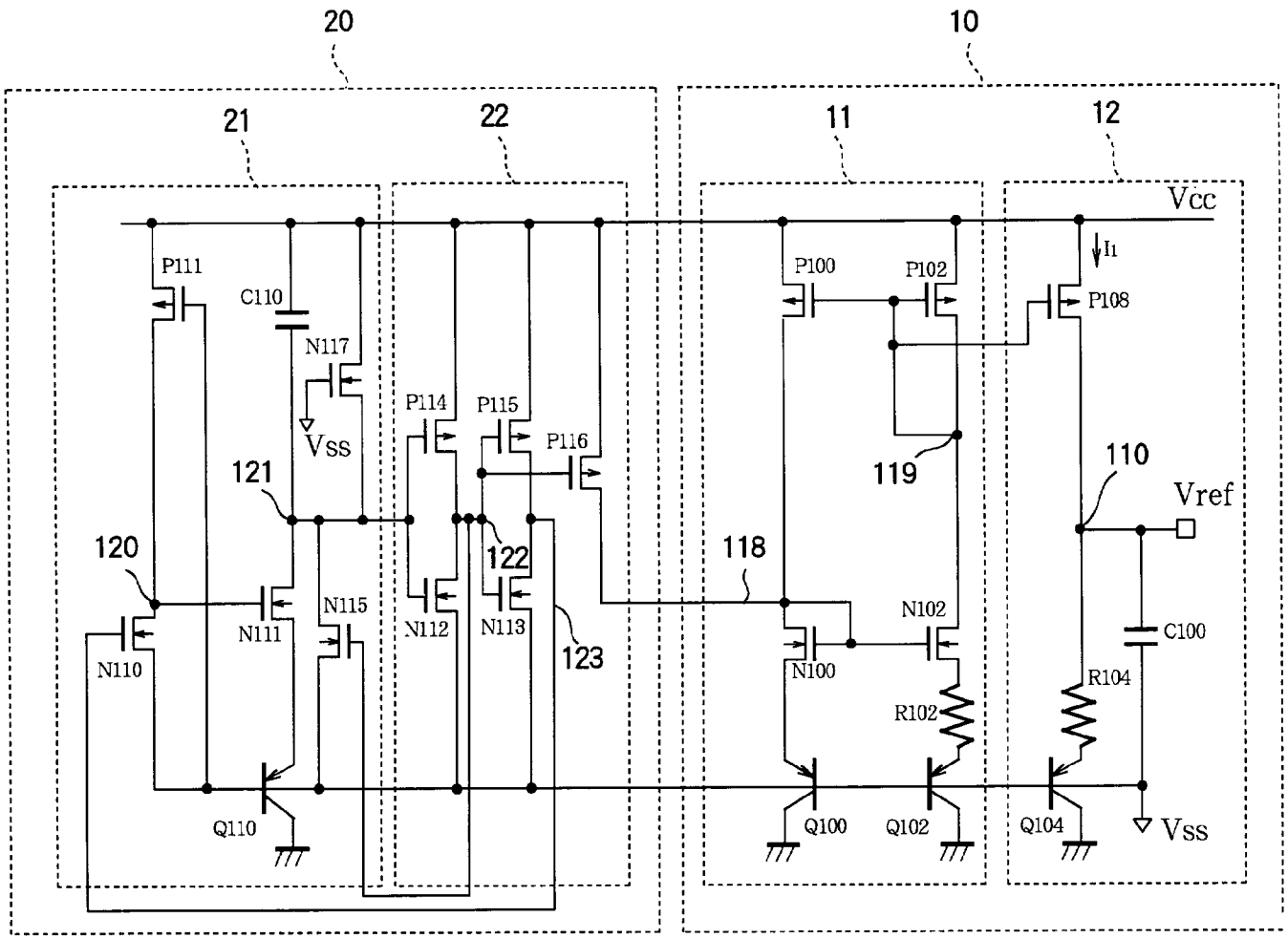
FIG. 7 is a circuit diagram of a bandgap reference voltage circuit illustrating a second variation of the second embodiment.

FIG. 7 is a circuit diagram of a bandgap reference voltage circuit illustrating a second variation of the second embodiment. In comparison with the second embodiment shown in FIG. 5, the start-up output circuit 22 in the start-up stage 20 has the same configuration while the reference stage 10 and the power supply voltage detection circuit 21 have different configurations.

The reference stage 10 in the second variation of the second embodiment has the same circuit topology as in the second variation of the first embodiment (FIG. 3). Compared with FIG. 5, transistors P104 and P106 and resistor R100 are eliminated from the constant-current circuit 11, transistor P109 is eliminated from the bandgap reference voltage output circuit 12, and transistor P112 is eliminated from the power supply voltage detection circuit 21.

In the second variation of the second embodiment, the start-up stage 20 keeps the common gate of n-channel transistors N100 and N102 in the constant-current circuit 11 pulled up to the high power supply Vcc until the high power supply Vcc reaches the voltage level VDSsatp111+Vbe110+Vtn111. The constant-current circuit 11 starts operating when the voltage at the common gate reaches a level sufficient to turn on transistors N100 and N102.

The second variation of the second embodiment is applicable if the bandgap reference voltage circuit is fabricated by a process such that (VDSsatp+Vtn)>(VDSsatn+Vtp) The constant-current circuit 11 can then maintain constant-current operation if the high power supply Vcc is at least Vbe100+VDSsatp100+Vtn100. This is lower than the VCC1 value given by equation (3), making the second variation of the second embodiment useful for low-voltage applications.

Third Variation of the Second Embodiment

Figure 8:
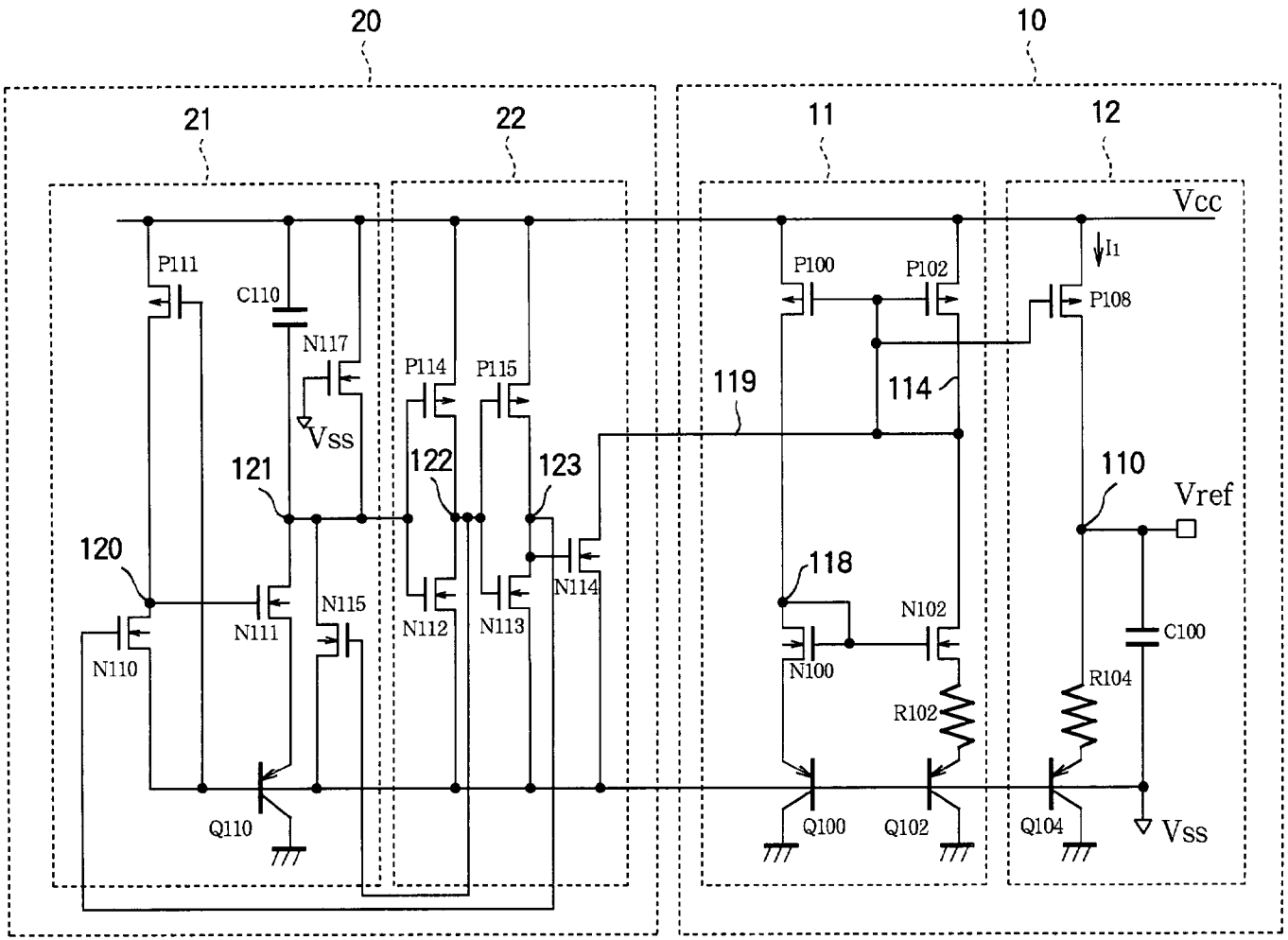
FIG. 8 is a circuit diagram of a bandgap reference voltage circuit illustrating a third variation of the second embodiment.

FIG. 8 is a circuit diagram of a bandgap reference voltage circuit illustrating a third variation of the second embodiment. The reference stage 10 and the power supply voltage detection circuit 21 of this circuit have the same configuration as in the second variation of the second embodiment, and the start-up output circuit 22 has the same configuration as in the first variation of the second embodiment. The drain of transistor N114 is coupled to a node 119 which functions as the starter node in the constant-current circuit 11.

In the bandgap reference voltage circuit of the third variation of the second embodiment, the common gate of p-channel transistors P100 and P102 is kept pulled down from when power is initially applied until the high power supply Vcc reaches the voltage level VDSsatp111+Vbe110+Vtn111. By this point transistors N100 and N102 have turned on and the constant-current circuit 11 can maintain constant-current operation on its own. This third variation has substantially the same effects as the second variation.

Third Embodiment

Figure 9:
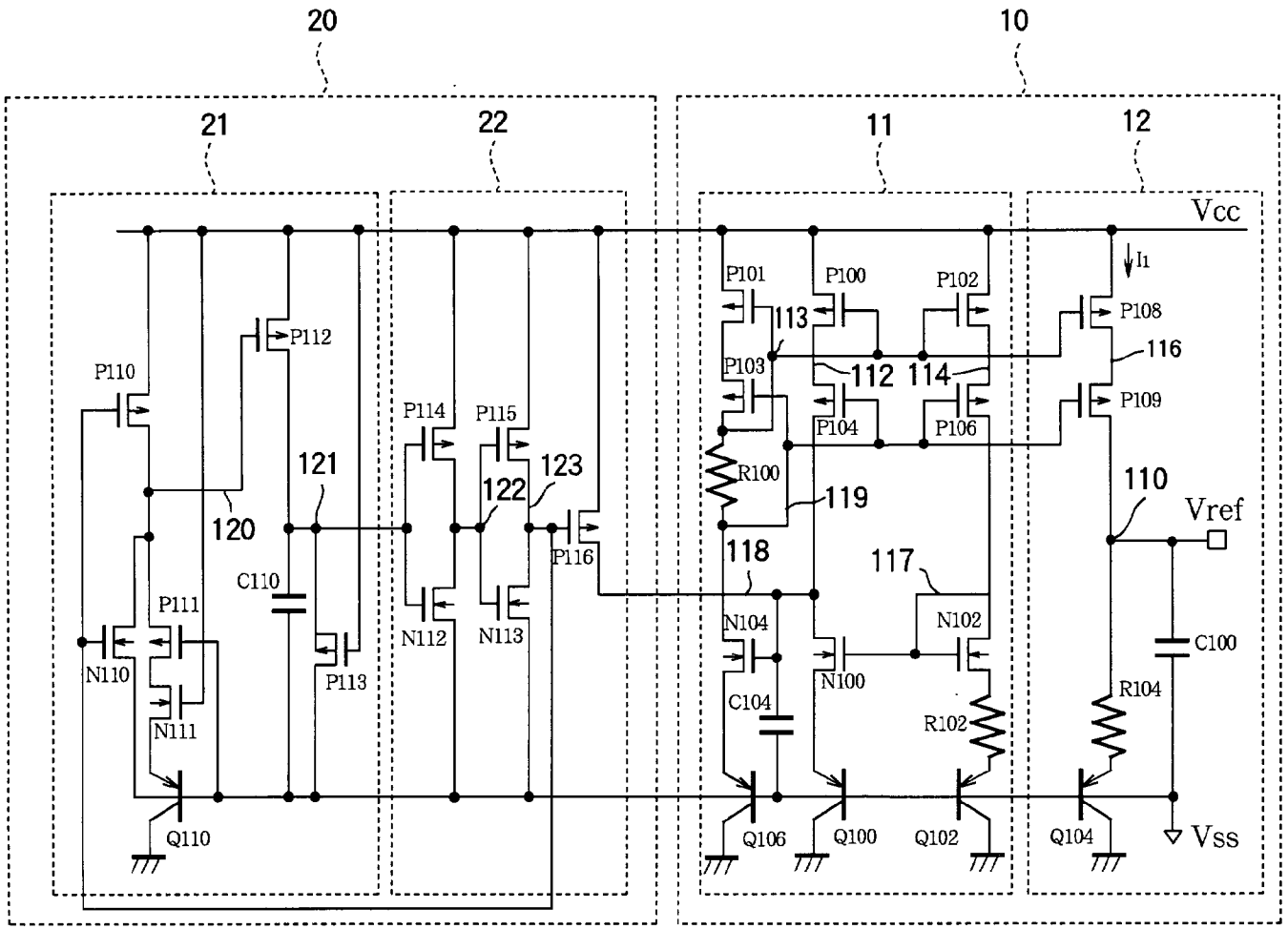
FIG. 9 is a circuit diagram of a bandgap reference voltage circuit illustrating a third embodiment of the invention.

FIG. 9 is a circuit diagram of a bandgap reference voltage circuit illustrating a third embodiment of the invention, this embodiment also comprising a reference stage 10 and a start-up stage 20. The start-up stage 20 has the same configuration as in the first embodiment, while the reference stage 10 has a different configuration.

The reference stage 10 comprises a constant-current circuit 11 and a bandgap reference voltage output circuit 12. The bandgap reference voltage output circuit 12 has the same configuration as in the first embodiment (see FIG. 1), while the constant-current circuit 11 has a different configuration.

Structure of the Reference Stage 10

The constant-current circuit 11 in the third embodiment differs from the constant-current circuit 11 in the preceding embodiments by including a third current path and a negative feedback loop. Specifically, the constant-current circuit 11 in FIG. 9 comprises a first triad of p-channel transistors P100, P101, and P102, a second triad of p-channel transistors P103, P104, and P106, a pair of n-channel transistors N100 and N102, and another n-channel transistor N104. The sources of transistors P100, P101, and P102, are coupled to the high power supply Vcc. The drains of transistors P100, P101, and P102, are coupled respectively to the sources of transistors P104, P103, and P106. The drains of transistors P104 and P106 are coupled respectively to the drains of transistors N100 and N102. The common gate of transistors N100 and N102 is coupled to a node 117 connected to the drains of transistors P106 and N102. The gate of transistor N104 is coupled to a node 118 connected to the drains of transistors P104 and N100. Transistors N100, N102, and N104 have identical specifications.

The constant-current circuit 11 further comprises resistors R100 and R102, pnp bipolar transistors Q100, Q102, and Q106, and a capacitor C104 that provides phase compensation for the negative feedback loop, which will be described later. Resistor R100 is coupled between the drains of transistors P103 and N104. Transistor Q100 has an emitter coupled to the source of transistor N100, a base coupled to the low power supply Vss, and a collector coupled to the substrate. Transistor Q106 has an emitter coupled to the source of transistor N104, a base coupled to the low power supply Vss, and a collector coupled to the substrate. Resistor R102 is coupled between the source of transistor N102 and the emitter of transistor Q102. Transistor Q102 has a base coupled to the low power supply Vss and a collector coupled to the substrate. The phase-compensation capacitor C104 is coupled between node 118 and the low power supply Vss.

Transistors P100, P101, P102, P103, P104, P106, P108, and P109 in the reference stage 10 have identical specifications. Transistors P100, P101, P102, and P108 form a first current mirror stage while transistors P103, P104, P106, and P109 form a second current mirror stage. The first and second stages form a cascode current mirror circuit in which the common gate of transistors P100, P101, P102, and P108 is coupled to a node 113, which is coupled to the drain of transistor P103, and the common gate of transistors P103, P104, P106, and P109 is coupled to a node 119, which is coupled to the drain of transistor N104 and to the drain of transistor P103 through resistor R100.

Transistors P111 and P112, transistor N111, and transistor Q110 in the power supply voltage detection circuit 21 in FIG. 9 have the same specifications as transistors P101 and P103, transistor N104, and transistor Q106, respectively, in the constant-current circuit 11.

Operation of the Third Embodiment

The operation of the third embodiment will be described under the assumptions that: the high power supply Vcc has reached the voltage level necessary for operation of the constant-current circuit 11; the emitter area ratio Q100:Q106:Q102 of transistors Q100, Q106, and Q102 is 1:1:N, where N is a positive number; and transistors Q100, Q106, and Q102 operate at collector current values in the diffusion region. Because the specifications of transistors P100, P101, P102, P103, P104, P106, P108, and P109 are the same, and the specifications of transistors N100, N102, and N104 are the same, the constant current $I_1$ generated by the constant-current circuit 11, flowing through transistors P100 and P102, P101 and P103, P104 and P106, and P108 and P109, is expressed by the same equation (1) as in the first embodiment, provided the drain voltage dependence of the drain current of each MOS transistor (the effective channel-length modulation effect) is ignored.

The purpose of the negative feedback loop in the constant-current circuit 11 in the third embodiment is to reduce the drain voltage dependence of transistors N100 and N102 on the high power supply Vcc. In the conventional constant-current circuit employed in the preceding embodiments, this dependence can have noticeable effects when Vcc has a high value.

In the first embodiment (FIG. 1), once the high power supply Vcc had reached the voltage level necessary for operation of the constant-current circuit 11 and the startup operation had ended, the drain voltage of transistor N100 was determined by the low power supply Vss, being clamped to a virtually constant level (Vbe100+Vtn100) equal to the sum of the base-emitter voltage of transistor Q100 and the threshold voltage of transistor N100. The drain voltage of transistor N102, however, was determined by the high power supply Vcc, being clamped to another virtually constant level (Vcc−(VDSsatp102+Vtp106)) obtained by subtracting the sum of the saturation source-drain voltage of transistor P102 and the threshold voltage of transistor P106 from the high power supply Vcc.

The difference between the drain voltages of transistors N100 and N102 (the potential difference between nodes 117 and 118) could thus be expressed as:

$$(Vcc-(VDSsatp102+Vtp106))-(Vbe100+Vtn100)$$

At the minimum voltage level VCC2 necessary for operation of the constant-current circuit 11 in the first embodiment, this potential difference was equal to VDSsatn102−Vtn100. If the high power supply Vcc continued to increase past the VCC2 level, however, the potential difference would increase further. Due to the effective channel-length modulation effect of transistors N102 and P104, the constant-current circuit 11 would then raise the potential of node 118 and move to an operating point with increased drain current. Therefore, if the high power supply voltage Vcc increased past VCC2, the actual constant current $I_1$ could increase above the $I_1$ value given by equation (1).

The negative feedback loop in the third embodiment reduces the potential increase at node 118 arising from the dependence of drain voltages and drain currents on the high power supply Vcc. In the constant-current circuit 11 in FIG. 9, if the potential of node 118 rises because of an increase in the high power supply Vcc, the gate-to-source voltage Vgs104 of transistor N104 rises. This increases the drain current Ids104 of transistor N104, decreasing the potentials at the common gates of transistors P100, P101, P102, and P108 and transistors P103, P104, P106, and P109. The drain current Ids100 of transistor N100 and the drain current Ids102 of transistor N102 then increase by virtually equal amounts. Because resistor R102 is coupled to the source of transistor N102, the voltage increase ΔV117 at node 117 caused by the increase ΔIds102 in the drain current Ids102 of transistor N102 is expressed as follows.

$$\Delta V117=\mathrm{SQRT}\ (\Delta Ids102/(k/2*W/L))+\Delta Ids102*r102+K*t/q*\mathrm{LN}(\Delta Ids102/(N*Is)) \quad (5)$$

The voltage increase ΔV118 at node 118 caused by the increase ΔIds100 in the drain current Ids100 of transistor N100 is expressed as follows.

$$\Delta V118=\mathrm{SQRT}\ (\Delta Ids100/(k/2*W/L))+K*t/q*\mathrm{LN}(\Delta Ids100/Is) \quad (6)$$

In equations (5) and (6), W/L is the width-to-length ratio of the n-channel transistor, K is the Boltzmann constant, T is absolute temperature, q is the charge of the electron, N is the emitter area ratio between transistors Q100 and Q102, and Is is the base-emitter reverse saturation current of transistor Q100. The constant k represents $\mu$n*Cox, where $\mu$n is the electron mobility and Cox is the capacitance of the gate oxide film of the transistor. SQRT(x) is the square root of x, and LN(x) is the natural logarithm of x.

The voltage changes expressed by the third term in equation (5) and the second term in equation (6) are logarithmically compressed with respect to the changes in drain current, making the values of these two terms much smaller than the values of the other terms. If those terms are ignored, equations (5) and (6) simplify to:

$$\Delta V117=\mathrm{SQRT}\ (\Delta Ids102/(k/2*W/L))+\Delta Ids102*r102 \quad (5)'$$

$$\Delta V118=\mathrm{SQRT}\ (\Delta Ids100/(k/2*W/L)) \quad (6)'$$

Because the increase ΔIds100 in the drain current Ids100 of transistor N100 is substantially equal to the increase ΔIds102 in the drain current Ids102 of transistor N102, the ΔV117 value given by equation (5)' is greater than the ΔV118 value given by equation (6)'. In other words, the potential at node 117, which is the gate potential of transistor N100, increases by more than is necessary to enable transistor N100 to conduct the additional drain current greater ΔIds100. Accordingly, the voltage at node 118 decreases.

Conversely, if the voltage at node 118 decreases below the proper level, then the gate potentials of the p-channel transistors rise, the drain current Ids100 of transistor N100 and the drain current Ids102 of transistor N102 decrease, and the potential of node 117 decreases, decreasing the gate-to-source voltage of transistor N100. This decrease outweighs the decrease ΔIds100 in the drain current Ids100 of transistor N100. Accordingly, the voltage at node 118 increases.

A negative feedback loop is thus established that confines the circuit operation range within narrow limits, minimizing the influence of variations in the voltage level of the high power supply Vcc on the voltages at nodes 117 and 118. The phase-compensation capacitor C104 prevents the negative feedback loop from becoming a positive feedback loop.

Given that transistor Q104 in the bandgap reference voltage output circuit 12 operates at a collector current value in the diffusion region, the voltage Vref at the output node 110 of the bandgap reference voltage output circuit 12 in FIG. 9 is the same as in the first embodiment, as given by equation (2), which ignores the drain voltage dependence of the drain currents of the MOS transistors (the effective channel-length modulation effect).

The constant-current circuit 11 can generate a constant current only when all of its p-channel and n-channel transistors P100, P101, P102, P103, P104, P106, N100, N102, and N104 are operating in the saturation region. If the transistors P100, P104, and N100 on path 112 are saturated, then the transistors P102, P106, and N102 on path 114 are also saturated. Therefore, the constant-current circuit 11 requires a high power supply voltage Vcc equal to or greater than the higher of the following two voltage levels: the lowest level (VCC1) of Vcc that enables transistors P100, P104, and N100 to operate in the saturation region on the series path 112 through transistors P100, P104, N100, and Q100; and the lowest level (VCC2) of Vcc that enables transistors P101, P103, and N104 to operate in the saturation region on the series path through transistors P101, P103, resistor R100, and transistors N104, and Q106.

Voltage level VCC1 can be expressed as in equation (3). level VCC2 can be expressed as follows.

$$VCC2=Vbe106+VDSsatn104+Vtp103+VDSsatp101 \quad (7)$$

Equation (7) assumes that the following two optimum design conditions are satisfied.

$$I_1*r100=VDSsatp101=VDSsatp103$$

$$Vtp101=Vtp103$$

In the third embodiment, when power is initially supplied, the start-up stage 20 brings the voltage at node 118 up to a level sufficient to turn on transistor N104, so that current can flow on the path through transistors P101, P103, N104, and Q106 to start the constant-current circuit 11. The start-up stage 20 in the third embodiment keeps node 118 pulled up to this level until the high power supply Vcc reaches the voltage level VCC2 given in equation (7). The second embodiment is thus applicable when the minimum voltage that enables the constant-current circuit 11 to operate independently is VCC2.

The start-up stage 20 operates in the same way in the third embodiment as in the first embodiment (see FIG. 1). After the start-up stage 20 starts up the constant-current circuit 11, the voltage at the starter node 118 changes from the pulled-up level, which is at least the sum of the source voltage of transistor N104 and the threshold voltage Vtn, to a steady-state voltage and is held steady by the negative feedback loop described above.

In the bandgap reference voltage circuit of the third embodiment, if the lower limit of the high power supply Vcc necessary for operation of the constant-current circuit 11 is the VCC2 value (Vbe106+VDSsatn104+Vtp103+VDSsatp101) given by equation (7), the lower limit VCC2 is defined by transistors P101, P103, N104, and Q106 in the constant-current circuit 11. The power supply voltage detection circuit 21 uses corresponding transistors P111, P112, N111, and Q110 to detect a voltage level VDSsatp111+VDSsatn111+Vbe110+Vtp112, which is equal to the lower limit VCC2. Until the high power supply Vcc reaches the VCC2 level, the start-up output circuit 22 keeps node 118 pulled up to a level sufficient to turn on transistor N104 in the constant-current circuit 11. When the high power supply Vcc reaches the VCC2 level (VDSsatp111+VDSsatn111+Vbe110+Vtp112), the pull-up operation is completed, and the supply of current from the start-up output circuit 22 ends.

As in the preceding embodiments, the bandgap reference voltage circuit in the third embodiment can start the constant-current circuit 11 and generate the bandgap reference voltage Vref with high reliability, irrespective of the speed with which the high power supply Vcc rises or the temperature characteristics of the components of the power supply voltage detection circuit, and can reduce power consumption and prevent increases in the bandgap reference voltage Vref after the high power supply Vcc reaches the lower limit value VCC2.

The bandgap reference voltage circuit in the third embodiment can generate a bandgap reference voltage reliably if the constant-current circuit 11 is capable of operating alone when the high power supply Vcc is above the VCC2 level; that is, if a fabrication process is used that makes (2*VDSsatp+Vtn)<(VDSsatn+Vtp+VDSsatp), so that VCC2 is higher than VCC1 (Vbe106+VDSsatn104+Vtp103+VDSsatp101>Vbc100+VDSsatp100+VDSsatp104+Vtn100).

In the bandgap reference voltage circuit of the third embodiment, as in the first embodiment, once the high power supply Vcc reaches VCC2, transistor P115 turns on and a low-impedance path is established between Vcc and node 123, so that the source and gate potentials of transistor P116 both remain in phase with power-supply noise, and the bandgap reference voltage will not gradually rise due to such noise. At the same time, transistor P110 is turned off, leaving no path on which unwanted current can flow through the start-up stage 20. As steady-state operation is thus free of unwanted current flow, power consumption is reduced.

The constant-current circuit 11 in the third embodiment also has a negative feedback loop that controls the potential of node 118. As a result, the-drain voltages of transistors N100 and N102 are determined independently of the level of the high power supply Vcc, and variations in difference between the drain voltage of transistor N100 and the drain voltage of transistor N102 caused by variations in the voltage level of the high power supply Vcc are reduced. Accordingly, variations in the constant current $I_1$ due to the effective channel-length modulation effect of transistors N102 and P104 are reduced. Correct circuit operation can therefore be ensured over a wide range of operating supply voltages, and an accurate bandgap reference voltage can be generated even if the bandgap reference voltage circuit is fabricated by a process that leads to a high effective channel-length modulation effect in p-channel and n-channel transistors.

First Variation of the Third Embodiment

Figure 10:
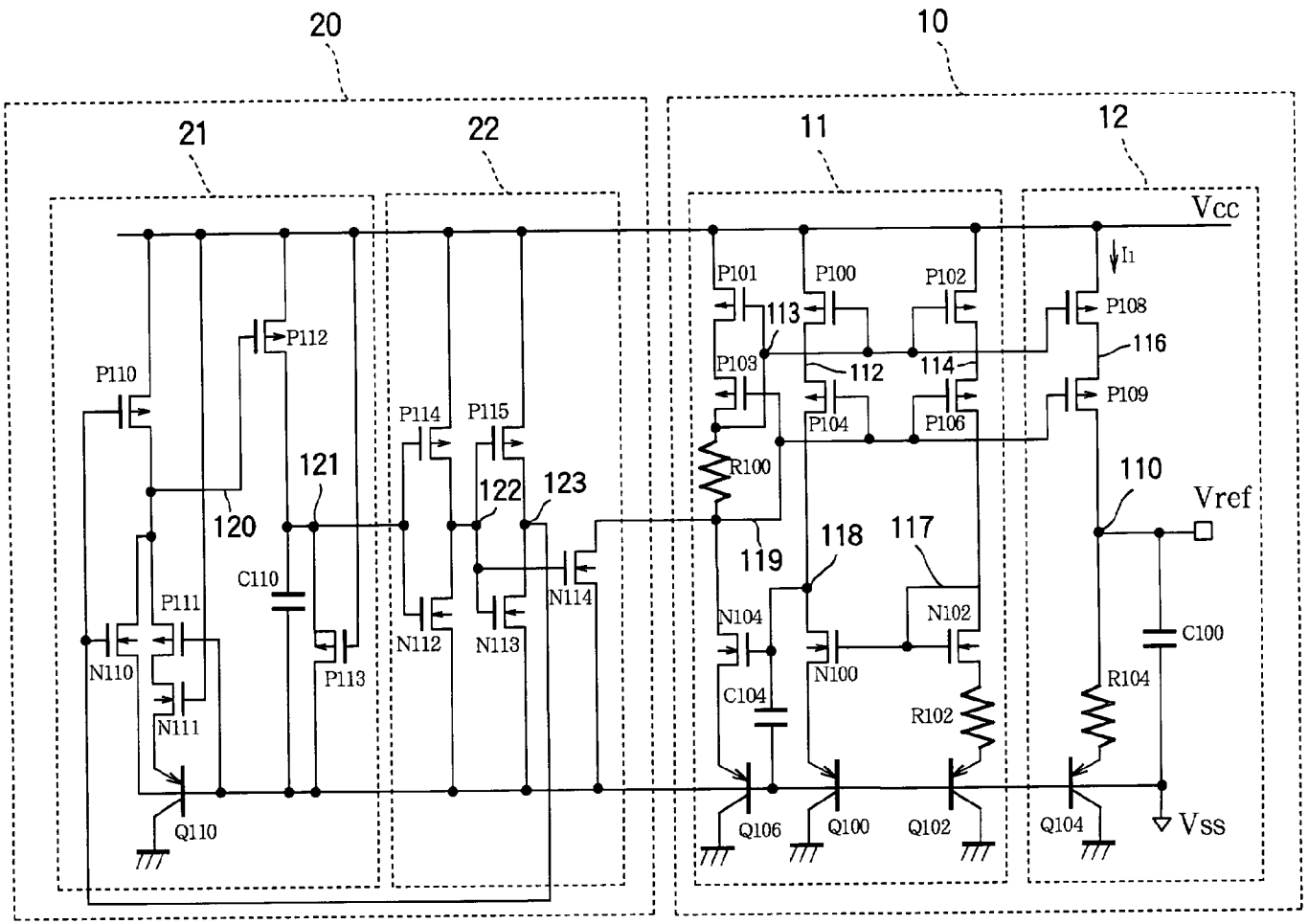
FIG. 10 is a circuit diagram of a bandgap reference voltage circuit illustrating a first variation of the third embodiment.

FIG. 10 is a circuit diagram of a bandgap reference voltage circuit illustrating a first variation of the third embodiment. In comparison with the circuit in FIG. 9, the reference stage 10 and the power supply voltage detection circuit 21 in the start-up stage 20 have the same configuration, while the start-up output circuit 22 has a different configuration.

The start-up output circuit 22 in FIG. 10 differs from the start-up output circuit 22 in FIG. 9 in that the start-up transistor is an n-channel transistor N114, instead of a p-channel transistor P116. Transistor N114 has a gate coupled to node 122, a source coupled to the low power supply Vss, and a drain coupled to node 119, which is now the starter node in the constant-current circuit 11.

The start-up stage 20 of the first variation of the third embodiment starts the constant-current circuit 11 by keeping node 119 pulled down until the high power supply Vcc reaches the VCC2 level value given by equation (7). This variation, like the first embodiment described above, is applicable if the constant-current circuit 11 can maintain constant-current operation when Vcc is higher than VCC2.

In the third embodiment as described above, the constant-current circuit 11 is started by pulling the gate voltage of n-channel transistor N104 up to the level of the high power supply Vcc so that transistor N104 can turn on quickly.

In the first variation of the third embodiment, the constant-current circuit 11 is started by pulling the common gate of p-channel transistors P103, P104, and P106 down to the level of the low power supply Vss. The common gate of transistors P100, P101, and P102 is also pulled down to the Vss level through resistor R100. This forces the cascode current mirror circuit comprising p-channel transistors P100, P101, and P102 and p-channel transistors P103, P104 and P106 to operate in a way that quickly brings nodes 117 and 118 to the level necessary for n-channel transistors N100, N102, and N104 to turn on, so that the constant-current circuit 11 can start up. The first variation has substantially the same effects as the third embodiment.

Second Variation of the Third Embodiment

Figure 11:
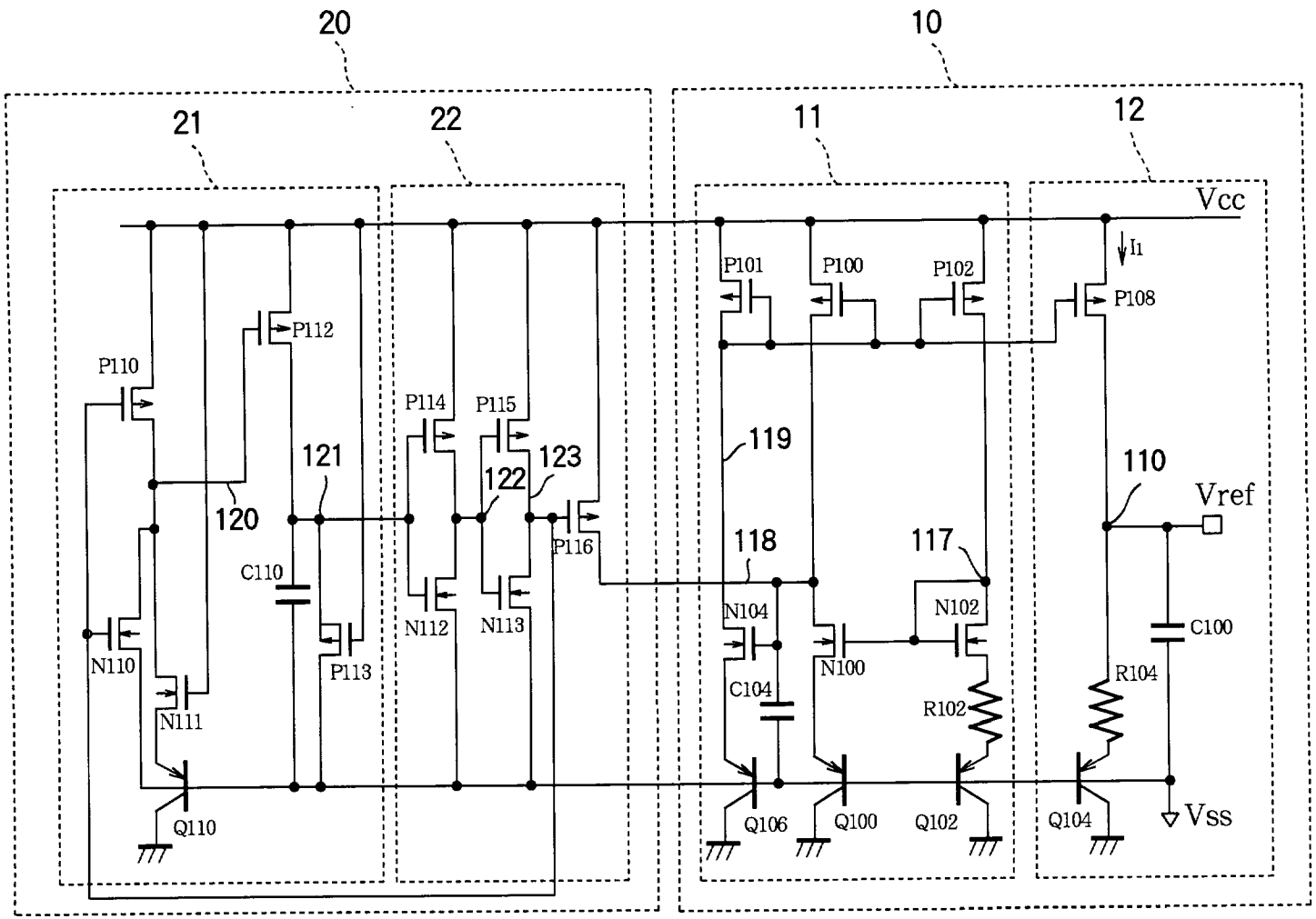
FIG. 11 is a circuit diagram of a bandgap reference voltage circuit illustrating a second variation of the third embodiment.

FIG. 11 is a circuit diagram of a bandgap reference voltage circuit illustrating a second variation of the third embodiment. In comparison with the third embodiment shown in FIG. 9, the start-up output circuit 22 in the start-up stage 20 has the same configuration, while the reference stage 10 and the power supply voltage detection circuit 21 have different configurations.

Whereas the constant-current circuit 11 in the third embodiment had p-channel transistors connected in a cascode current mirror configuration, the second variation employs a simpler current mirror configuration. The constant-current circuit 11 in FIG. 11 differs from the constant-current circuit 11 in FIG. 9 in that transistors P104, P106, and P103 and resistor R100 are eliminated. The bandgap reference voltage output circuit 12 in FIG. 11 differs from the bandgap reference voltage output circuit 12 in FIG. 9 in that transistor P109 is eliminated. The power supply voltage detection circuit 21 in FIG. 11 differs from the power supply voltage detection circuit 21 in FIG. 9 in that transistor P111 is eliminated.

In the second variation of the third embodiment, the start-up stage 20 keeps the gate voltage of n-channel transistor N104 in the constant-current circuit 11 pulled up to the level of the high power supply Vcc until Vcc reaches the sum of the threshold voltage of p-channel transistor P112, the saturation source-drain voltage of n-channel transistor N111, and the base-emitter voltage of bipolar transistor Q110 (VDSsatn111+Vbe110+Vtp112). The constant-current circuit 11 starts up when the gate potential of transistor N104 reaches a level sufficient for transistor N104 to turn on.

The second variation of the third embodiment is applicable if the bandgap reference voltage circuit is fabricated by a process such that (VDSsatp+Vtn)<(VDSsatn+Vtp). The constant-current circuit 11 can then maintain constant-current operation if the high power supply Vcc is at least the sum of the threshold voltage of p-channel transistor P102, the saturation source-drain voltage of n-channel transistor N102, and the base-emitter voltage of bipolar transistor Q100 (Vbe100+VDSsatn102+Vtp102). This is lower than the VCC2 value given by equation (7), making the second variation of the third embodiment useful for low-voltage applications.

Third Variation of the Third Embodiment

Figure 12:
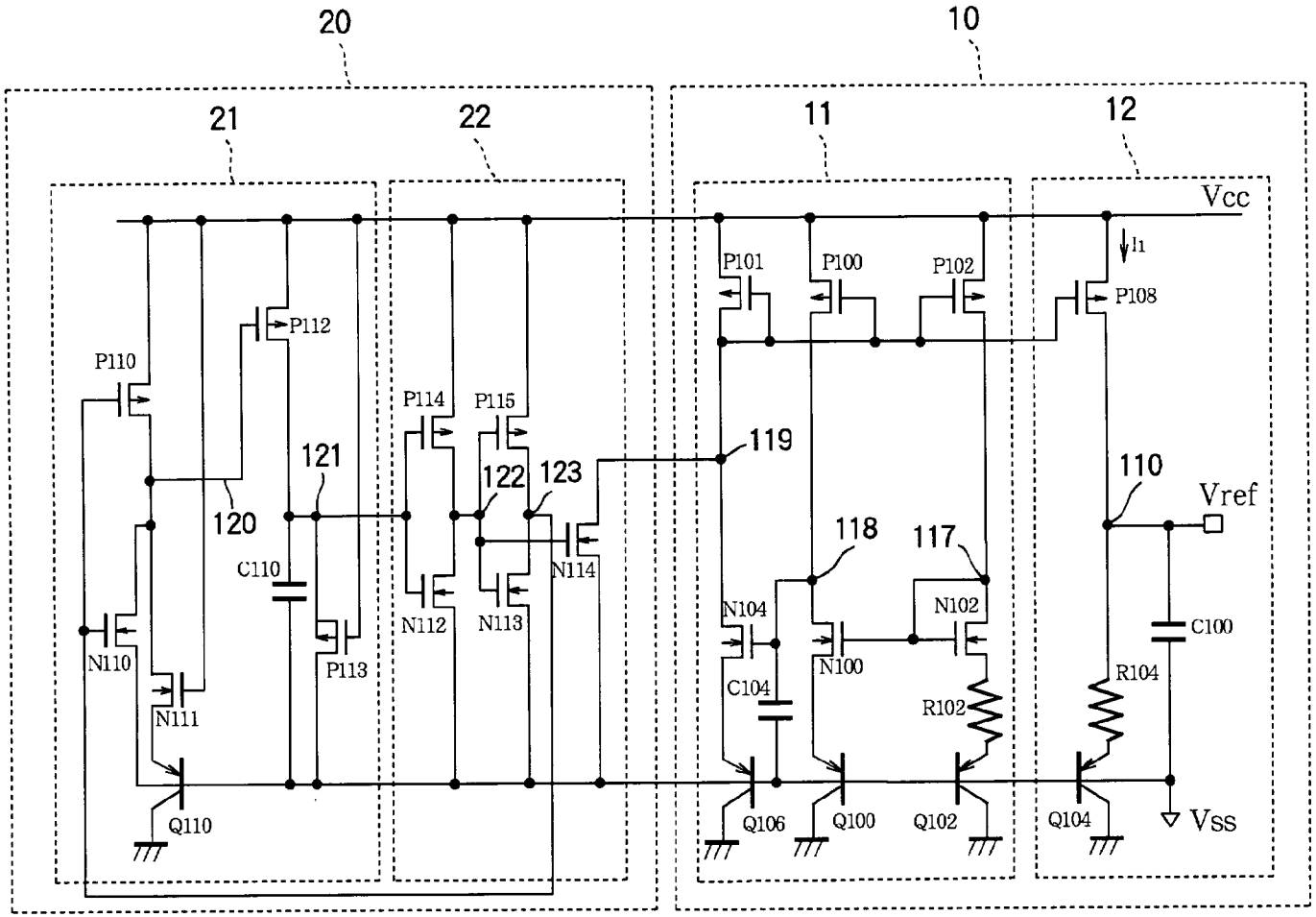
FIG. 12 is a circuit diagram of a bandgap reference voltage circuit illustrating a third variation of the third embodiment.

FIG. 12 is a circuit diagram of a bandgap reference voltage circuit illustrating a third variation of the third embodiment. The reference stage 10 and the power supply voltage detection circuit 21 of this circuit have the same configuration as in the second variation of the third embodiment, and the start-up output circuit 22 has the same configuration as in the first variation of the third embodiment.

In the start-up stage 20 of the third variation of the third embodiment, the common gate of p-channel transistors P100, P101, and P102 is pulled down to the low power supply level Vss until the high power supply Vcc reaches the voltage level VDSsatn111+Vbe110+Vtp112. By this time transistors N100, N102, and N104 have turned on and the constant-current circuit 11 can maintain constant-current operation on its own. This third variation has substantially the same effects as the second variation.

Fourth Embodiment

Figure 13:
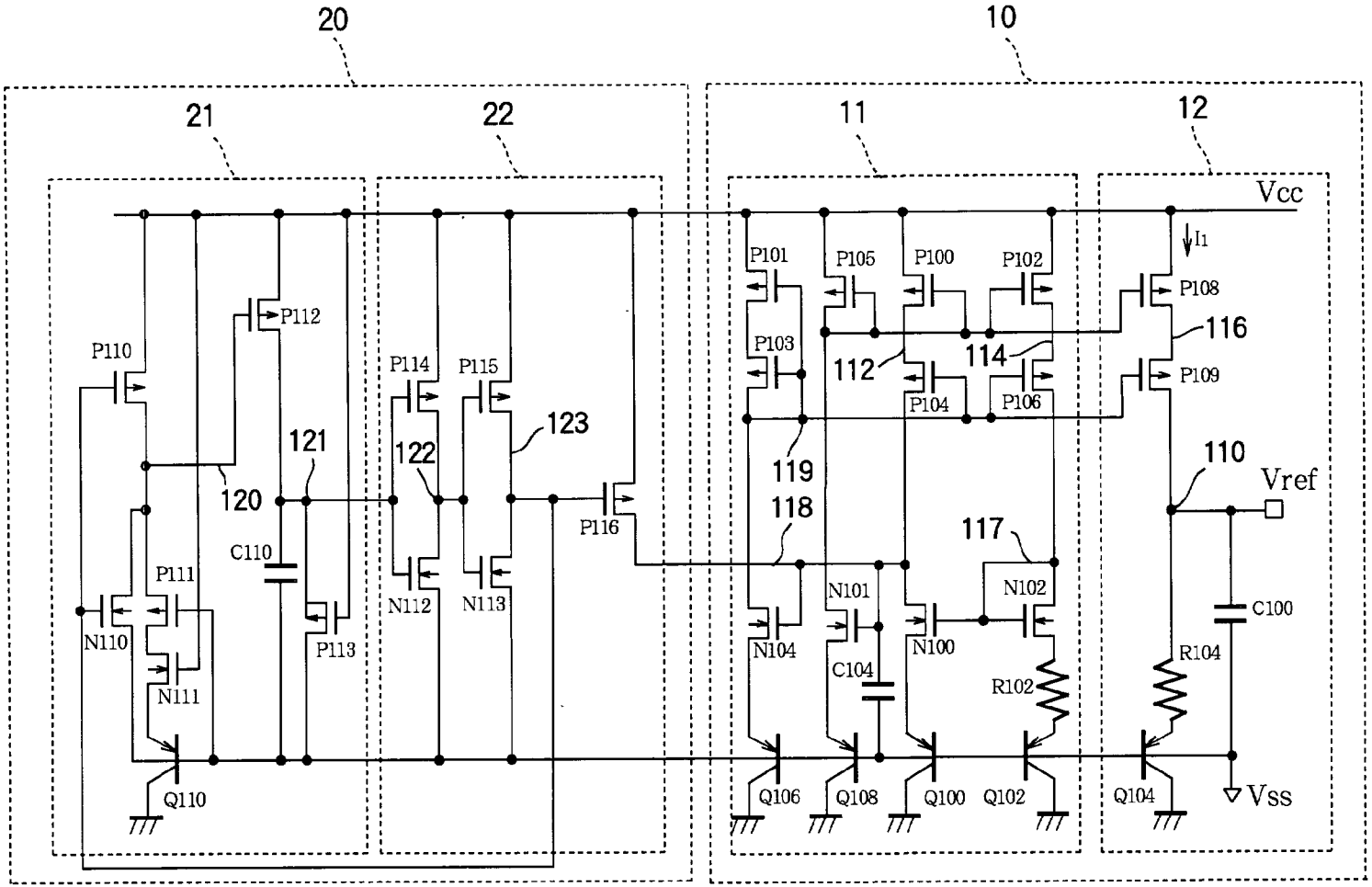
FIG. 13 is a circuit diagram of a bandgap reference voltage circuit illustrating a fourth embodiment of the invention.

FIG. 13 is a circuit diagram of a bandgap reference voltage circuit illustrating a fourth embodiment of the invention, comprising a reference stage 10 and a start-up stage 20. The start-up stage 20 has the same configuration as in the first and third embodiments. The reference stage 10 has a different configuration.

As in the preceding embodiments, the reference stage 10 of the fourth embodiment comprises a constant-current circuit 11 and a bandgap reference voltage output circuit 12. The bandgap reference voltage output circuit 12 has the same configuration as in all of the preceding embodiments. The constant-current circuit 11 has a different configuration from the constant-current circuit 11 in any of the preceding embodiments or their variations.

The constant-current circuit 11 in FIG. 13 comprises seven p-channel transistors P100–P106 and four n-channel transistors N100, N101, N102, and N104. The sources of transistors P100, P101, P102, and P105, are coupled to the high power supply Vcc. The drains of transistors P100, P101, and P102 are coupled respectively to the sources of transistors P104, P103, and P106. The drains of transistors P104, P103, and P106 are coupled respectively to the drains of transistors N100, N104, and N102. The drain of transistor P105 is coupled to the drain of transistor N101. The common gate of transistors N100 and N102 is coupled to a node 117 connected to the drains of transistors P106 and N102. The gates of transistors N100 and N104 are coupled to a node 118 connected to the drains of transistors P104 and N100. Transistors N100, N101, N102, and N104 have identical specifications.

The constant-current circuit 11 further comprises a resistor R102, pnp bipolar transistors Q100, Q102, Q106, and Q108, and a capacitor C104 that provides phase compensation for a feedback loop. Transistor Q100 has an emitter coupled to the source of transistor N100, a base coupled to the low power supply Vss, and a collector coupled to the substrate. Transistor Q106 has an emitter coupled to the source of transistor N104, a base coupled to the low power supply Vss, and a collector coupled to the substrate. Transistor Q108 has an emitter coupled to the source of transistor N101, a base coupled to the low power supply Vss, and a collector coupled to the substrate. Resistor R102 is coupled between the source of transistor N102 and the emitter of transistor Q102. Transistor Q102 has a base coupled to the low power supply Vss and a collector coupled to the substrate. The phase-compensation capacitor C104 for the feedback loop in the constant-current circuit 11 is coupled between node 118 and the low power supply Vss.

Transistors P100, P102, P103, P104, P106, P108, and P109 in the reference stage 10 have identical specifications. The common gate of transistors P100, P102, P105, and P108 is coupled to a node connected to the drain of transistor P105. The common gate of transistors P101, P103, P104, P106, and P109 is coupled to a node 119 connected to the drain of transistor P103. Transistors P100, P102, P105, and P108 form a first current mirror stage, while transistors P104, P106, and P109 form a second current mirror stage. Transistors P100, P102, and P108 in the first stage and transistors P104, P106, and P109 in the second stage form a cascode current mirror circuit. Transistor P105 in the first stage functions as a diode and applies a bias voltage to the common gate of transistors P100, P102, and P108. Transistors P101 and P103 in the second stage function as diodes and apply a bias voltage to the common gate of transistors P104, P106, and P109.

Transistors P111 and P112, transistor N111, and transistor Q110 in the power supply voltage detection circuit 21 in FIG. 13 have the same specifications as transistors P101 and P103, transistor N104, and transistor Q106, respectively, in the constant-current circuit 11.

Operation of the Fourth Embodiment

The operation of the bandgap reference voltage circuit of the fourth embodiment shown in FIG. 13 will be described under the assumptions that: the high power supply Vcc has reached the voltage level necessary for operation of the constant-current circuit 11; the emitter area ratio Q100:Q108:Q106:Q102 of transistors Q100, Q108, Q106, and Q102 is 1:1:1:N, where N is a positive number; and transistors Q100, Q108, Q106, and Q102 operate at collector current values in the diffusion region. Because the specifications of transistors P100, P102, P103, P104, P105, P106, P108, and P109 are the same, and the specifications of transistors N100, N101, N102, and N104 are the same, the constant current $I_1$ generated by the constant-current circuit 11, flowing through transistors P100 and P104, P101 and P103, P102 and P106, and P108 and P109, is expressed by the same equation (1) as in the first embodiment, provided the drain voltage dependence of the drain current of each MOS transistor (effective channel-length modulation effect) is ignored.

Like the constant-current circuit 11 in the third embodiment, the constant-current circuit 11 in the fourth embodiment has a negative feedback loop. The constant-current circuit 11 of the fourth embodiment differs from the constant-current circuit 11 in the first embodiment (see FIG. 1) and from the conventional constant-current circuit in that the drain voltage dependence of transistors N100 and N102 on the high power supply Vcc is greatly reduced.

As explained in the third embodiment, if the high power supply Vcc continues to rise after passing the voltage level VCC2 necessary for operation of the constant-current circuit 11 in the first embodiment, the difference between the drain voltages of transistors N100 and N102 also increases, the difference being expressed as:

$$(Vcc-(VDSsatp102+Vtp106))-(Vbe100+Vtn100)$$

As the difference between the drain voltages of transistors N100 and N102 increases, due to the effective channel-length modulation effect of transistors N102 and P104, the constant-current circuit 11 raises the voltage at node 118 and moves to an operating point with increased drain current. Therefore, as the high power supply voltage Vcc ramps up, the actual constant current $I_1$ increases above the $I_1$ value given by equation (1).

The constant-current circuit 11 in the fourth embodiment uses a negative feedback loop to minimize the increase in voltage at node 118 arising from the dependence on the high power supply Vcc, as in the third embodiment. In the constant-current circuit 11 in FIG. 13, if the voltage at node 118 increases as the high power supply Vcc increases, the gate-to-source voltage Vgs104 of transistor N104 and the gate-to-source voltage Vgs101 of transistor N101 rise. This increases the drain current Ids104 of transistor N104 and the drain current Ids101 of transistor N101, decreasing the voltages at the common gates of transistors P100, P102, P105, and P108 and transistors P103, P104, P106, and P109. The drain current Ids100 of transistor N100 and the drain current Ids102 of transistor N102 then increase by virtually equal amounts. Because resistor R102 is coupled to the source of transistor N102, the voltage increase ΔV117 at node 117 caused by the increase ΔIds102 in the drain current Ids102 of transistor N102 is expressed by equation (5). The voltage increase ΔV118 at node 118 caused by the increase ΔIds100 in the drain current Ids100 of transistor N100 is expressed by the equation (6). Accordingly, the voltage at node 118 decreases, as explained in the third embodiment. The phase-compensation capacitor C104 is provided to prevent the negative feedback loop from becoming a positive feedback loop.

In the third embodiment, the resistance of resistor R100 was set so that $$VDSsatp101/I_1=VDSsatp103/I_1$$

in order to bring the voltage at the common gate of transistors P104, P106, and P109 in the second current mirror stage to the voltage level Vcc−(Vtp+VDSsatp), so that the cascode current mirror circuit formed by the first stage comprising transistors P100, P101, P102, and P108 and the second stage comprising transistors P103, P104, P106, and P109 in the reference stage 10 can operate at a low voltage.

In the fourth embodiment, however, the dimensions of transistor P101 are set so that $$\text{VDS satp}101=\text{VDS satp}100=\text{VDS satp}102$$

so that the voltage at the common gate of transistors P104, P106, and P109 in the second current mirror stage becomes equal to Vcc−(Vtp+VDSsatp).

If transistor Q104 in the bandgap reference voltage output circuit 12 in FIG. 13 operates at a collector current value in the diffusion region, the voltage Vref at the output node 110 of the bandgap reference voltage output circuit 12 is the same as in the first embodiment, as given by equation (2), ignoring the drain voltage dependence of the drain currents of the MOS transistors (effective channel-length modulation effect).

The constant-current circuit 11 of the fourth embodiment in FIG. 13 can generate a constant current only when all of its p-channel and n-channel transistors P100, P102, P103, P104, P105, P106, N100, N101, N102, and N104 are operating in the saturation region. Therefore, the constant-current circuit 11 requires a high power supply voltage Vcc equal to or greater than the higher of the following two voltage levels: the lowest level (VCC1) of Vcc that enables transistors P100, P104, and N100 to operate in the saturation region on the series path 112 through transistors P100, P104, N100, and Q100; and the lowest level (VCC2) of Vcc that enables transistors P101, P103, and N104 to operate in the saturation region on the series path through transistors P101, P103, N104, and Q106. The VCC1 value is expressed by equation (3) while the VCC2 value is expressed by equation (7).

In the bandgap reference voltage circuit of the fourth embodiment, as in the preceding embodiments, the start-up stage 20 is needed to bring the voltage at node 118 up to a level sufficient to turn on transistors N100 and N102 when power is initially supplied. The start-up stage 20 operates in the same way in the fourth embodiment as in the first embodiment (see FIG. 1). After the start-up stage 20 starts up the constant-current circuit 11, the voltage at the starter node 118 changes from the pulled-up level, which is at least the sum of the source voltage of transistors N100 and N102 and their threshold voltage Vtn, to a steady-state voltage and is held steady by the negative feedback loop.

If the minimum high power supply voltage Vcc necessary for operation of the constant-current circuit 11 is the VCC2 value (Vbe106+VDSsatn104+Vtp103+VDSsatp101) given by equation (7), the bandgap reference voltage circuit of the fourth embodiment can start the constant-current circuit 11 and generate the bandgap reference voltage Vref with high reliability, irrespective of the speed with which the high power supply Vcc rises or the temperature characteristics of the components of the power supply voltage detection circuit, and can reduce power consumption and prevent increases in the bandgap reference voltage Vref after the high power supply Vcc reaches the lower limit value VCC2. The bandgap reference voltage circuit in the fourth embodiment can generate a bandgap reference voltage reliably if the device is fabricated by a process that makes (2*VDSsatp+Vtn)<(VDSsatn+Vtp+VDSsatp).

In the bandgap reference voltage circuit of the fourth embodiment, as in the first embodiment, once the high power supply Vcc reaches the lower limit value VCC2, a low-impedance path is established between the high power supply Vcc and node 123, so that the bandgap reference voltage will not gradually rise due to power-supply noise. At the same time, transistor P110 in the power supply voltage detection circuit 21 is turned off, leaving no path on which unwanted current can flow through the start-up stage 20. As steady-state operation is thus free of unwanted current flow, power consumption is reduced.

The constant-current circuit 11 in the fourth embodiment also has a negative feedback loop that controls the potential of node 118. As a result, variations in the constant current $I_1$ due to the effective channel-length modulation effect of transistors N102 and P104 are minimized. Correct circuit operation can therefore be ensured over a wide range of operating supply voltages, and an accurate bandgap reference voltage can be generated even if the bandgap reference voltage circuit is fabricated by a process that leads to a high effective channel-length modulation effect in p-channel and n-channel transistors.

Figure 21:
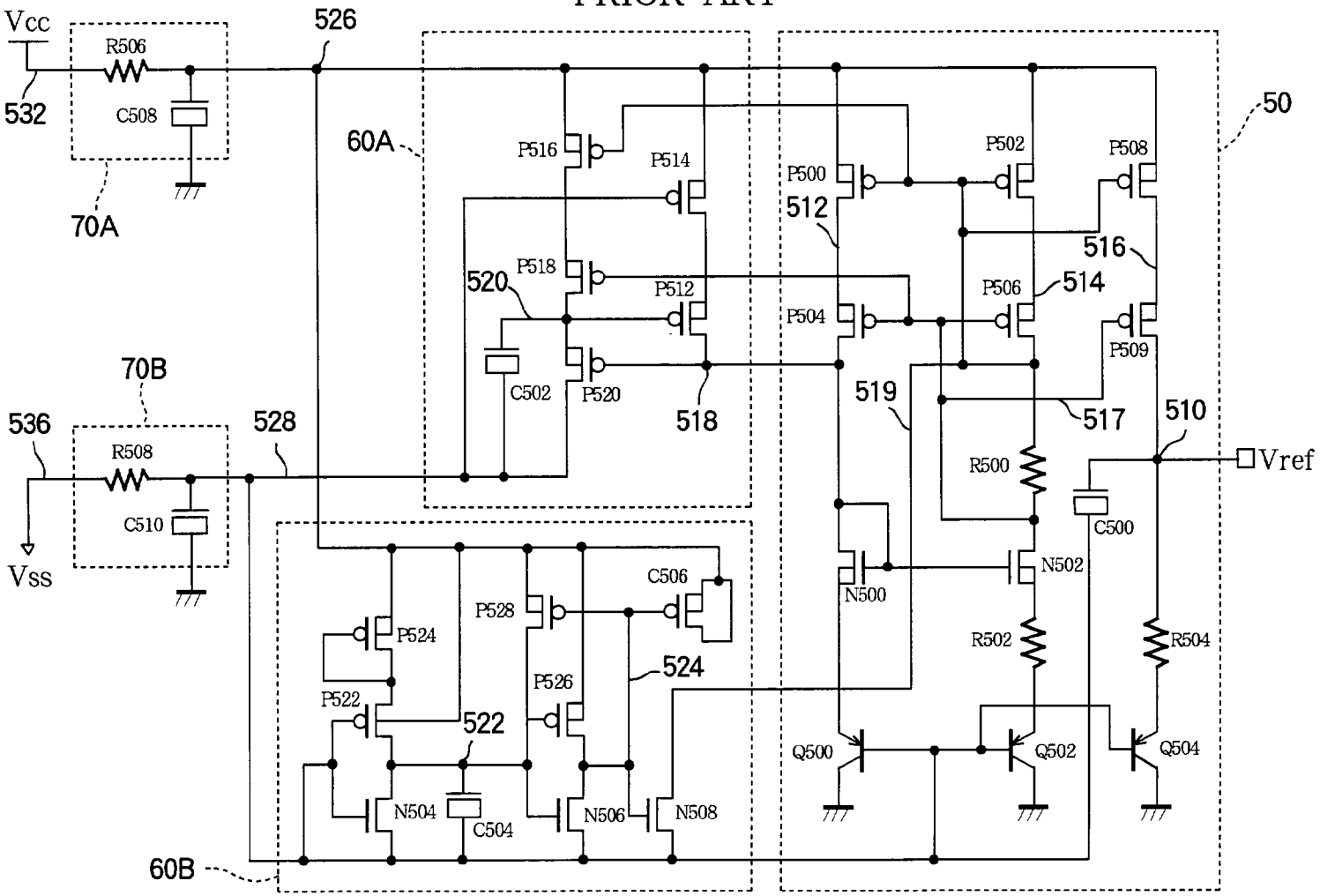
FIG. 21 PRIOR ART
FIG. 21 is a circuit diagram of a conventional bandgap reference voltage circuit.

In the conventional bandgap reference voltage circuit shown in FIG. 21, the resistance r100 of resistor R100 is set to VDSsatp/$I_1$ in order to bring the voltage at the common gate of the p-channel transistors in the second stage of the cascode current mirror circuit to the voltage level Vcc−(Vtp+VDSsatp), so that the cascode current mirror circuit in the reference stage 10 can operate at a low voltage. The bias voltage of the cascode current mirror circuit is determined by a resistor R100, but this resistor that may be subject to different fabrication variations from the variations of the p-channel transistors. There is a risk that the resistance r100 of resistor R100 may become less than VDSsatp/$I_1$, because of a combination of fabrication variations and the operating temperature, in which case the p-channel transistors in the first stage of the cascode current mirror circuit operate in the non-saturation region.

In the bandgap reference voltage circuit in the fourth embodiment, however, the dimensions of transistor P101 are set to make VDSsatp101=VDSsatp100=VDSsatp102 in order to bring the voltage at the common gate of transistors P104, P106, and P109 in the second current mirror stage to the voltage level Vcc−(Vtp+VDSsatp), so that the cascode current mirror circuit formed by the first stage comprising transistors P100, P101, P102, and P108 and the second stage comprising transistors P103, P104, P106, and P109 can operate at a low voltage. Because all of the circuit elements involved in this cascode current mirror are p-channel transistors, their electrical characteristics vary in the same way due to fabrication variations, so the risk of non-saturation operation of the p-channel transistors in the first stage of the cascode current mirror circuit is reduced. More specifically, because the load disposed in the cascode current mirror circuit of the constant-current circuit 11 to enable low-voltage operation is a p-channel MOS transistor load instead of a resistor load, relative variations among the circuit elements can be reduced, ensuring that the p-channel transistors in the first stage operate in the saturation region.

Variation of the Fourth Embodiment

Figure 14:
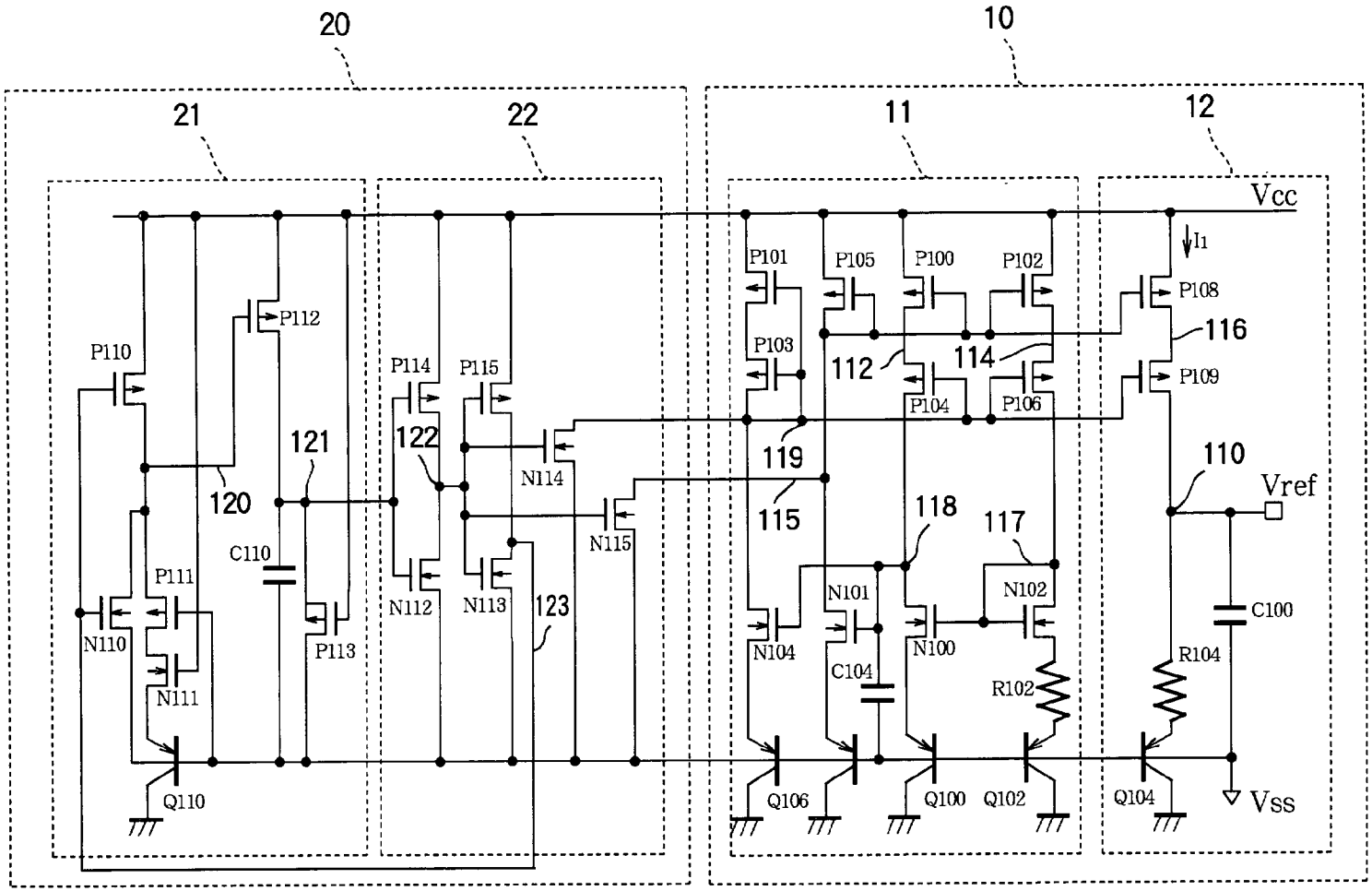
FIG. 14 is a circuit diagram of a bandgap reference voltage circuit illustrating a variation of the fourth embodiment.

FIG. 14 is a circuit diagram of a bandgap reference voltage circuit illustrating a variation of the fourth embodiment. In comparison with the circuit in FIG. 13, the reference stage 10 and the power supply voltage detection circuit 21 in the start-up stage 20 have the same configuration, while the start-up output circuit 22 has a different configuration.

The start-up output circuit 22 in FIG. 14 differs from the start-up output circuit 22 in FIG. 13 in having two n-channel start-up transistors N114 and N115, instead of a single p-channel transistor start-up P116. Transistor N114 has a gate coupled to node 122, a source coupled to the low power supply Vss, and a drain coupled to node 119, which is now a starter node in the constant-current circuit 11. Transistor N115 has a gate coupled to node 122, a source coupled to the low power supply Vss, and a drain coupled to a node 115, which is another starter node in the constant-current circuit 11.

In the fourth embodiment, the constant-current circuit 11 is started by pulling the common gate of n-channel transistors N101 and N104 up to the level of the high power supply Vcc until Vcc reaches the voltage level VDSsatp111+VDSsatn111+Vbe110+Vtp112.

In the variation of the fourth embodiment, the constant-current circuit 11 is started by pulling the common gate of p-channel transistors P104 and P106 down to the level of the low power supply Vss. The common gate of transistors P100 and P102 is also pulled down to the Vss level. This forces the cascode current mirror circuit comprising p-channel transistors P100, P102, P104, and P106 to operate in a way that quickly brings nodes 117 and 118 to the level necessary for n-channel transistors N100, N101, N102, and N104 to turn on, so that the constant-current circuit 11 can start up. The variation of the fourth embodiment has substantially the same effects as the fourth embodiment itself.

Fifth Embodiment

Figure 15:
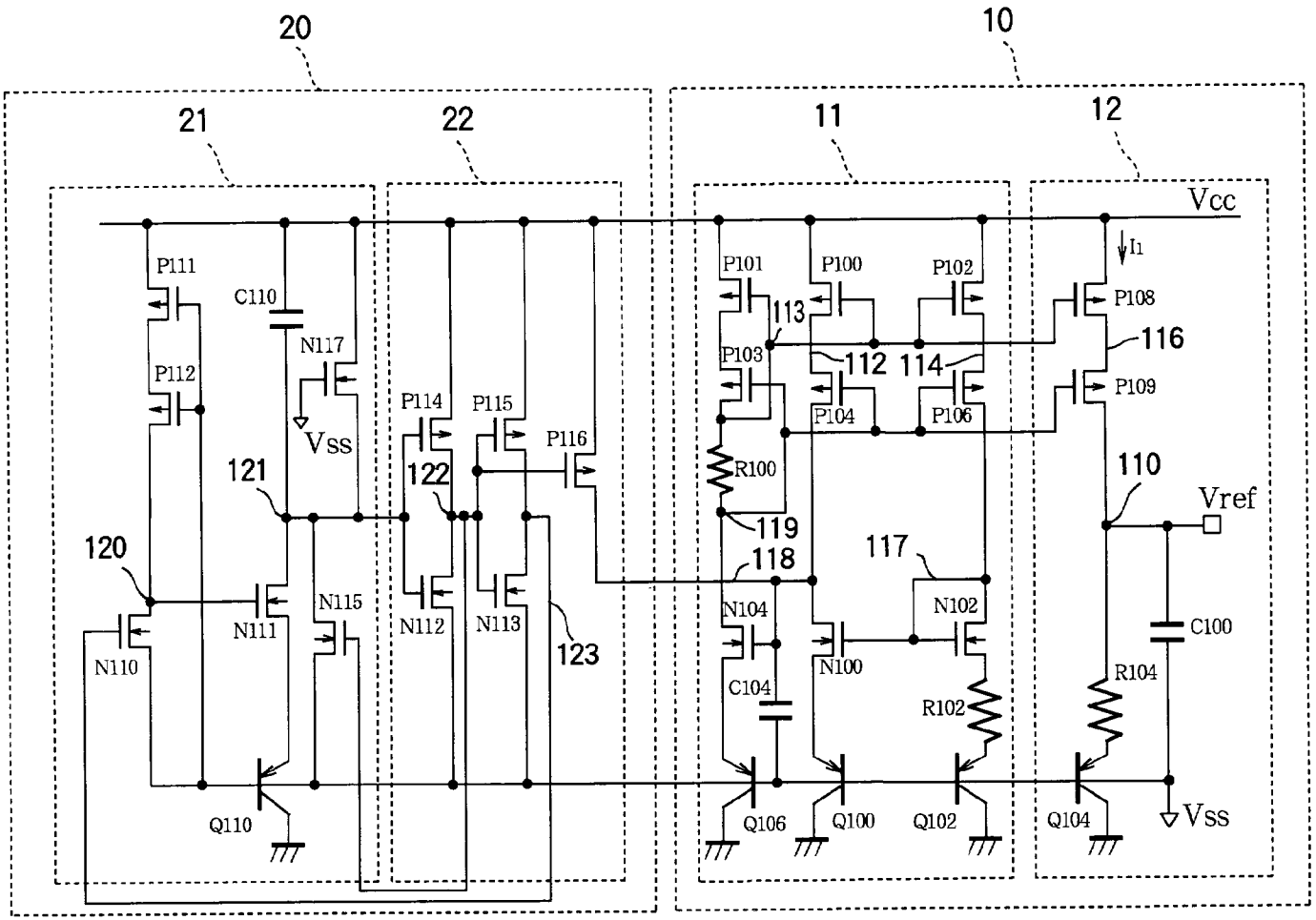
FIG. 15 is a circuit diagram of a bandgap reference voltage circuit illustrating a fifth embodiment of the invention.

FIG. 15 is a circuit diagram of a bandgap reference voltage circuit illustrating a fifth embodiment of the invention, comprising a reference stage 10 that has the same configuration as in the third embodiment, and a start-up stage 20 that has the same configuration as in the second embodiment.

Transistors P111 and P112, transistor N111, and transistor Q110 in the power supply voltage detection circuit 21 in FIG. 15 have the same specifications as transistors P100 and P104, transistor N100, and transistor Q100, respectively, in the constant-current circuit 11.

The reference stage 10 in the fifth embodiment operates in the same way as the reference stage 10 in the third embodiment (see FIG. 9), employing a negative feedback loop. The start-up stage 20 in the fifth embodiment operates in the same way as in the second embodiment. During power-up, the gate of n-channel transistor N104 in the constant-current circuit 11 is pulled up to the level of the high power supply Vcc until Vcc reaches the voltage level. VDSsatp111+VDSsatp112+Vbe110+Vtn111, which is equal to the VCC1 value given by equation (3). This pull-up operation turns on transistor N104, then transistors P100–P106, then transistors N100 and N102, thereby starting the constant-current circuit 11. If the minimum high power supply voltage Vcc necessary for operation of the constant-current circuit 11 is the VCC1 value, then after the pull-up operation by the start-up stage 20 ends, the constant-current circuit 11 can continue operating on its own. The voltage at the starter node 118 changes from the pulled-up level, which is at least the sum of the source voltage of transistors N100 and N102 and their threshold voltage Vtn, to a steady-state voltage, and is held steady by the negative feedback loop.

In the bandgap reference voltage circuit of the fifth embodiment, the start-up stage 20 has the same effects as in the second embodiment, and the constant-current circuit 11 has the same effects as in the third embodiment.

First Variation of the Fifth Embodiment

Figure 16:
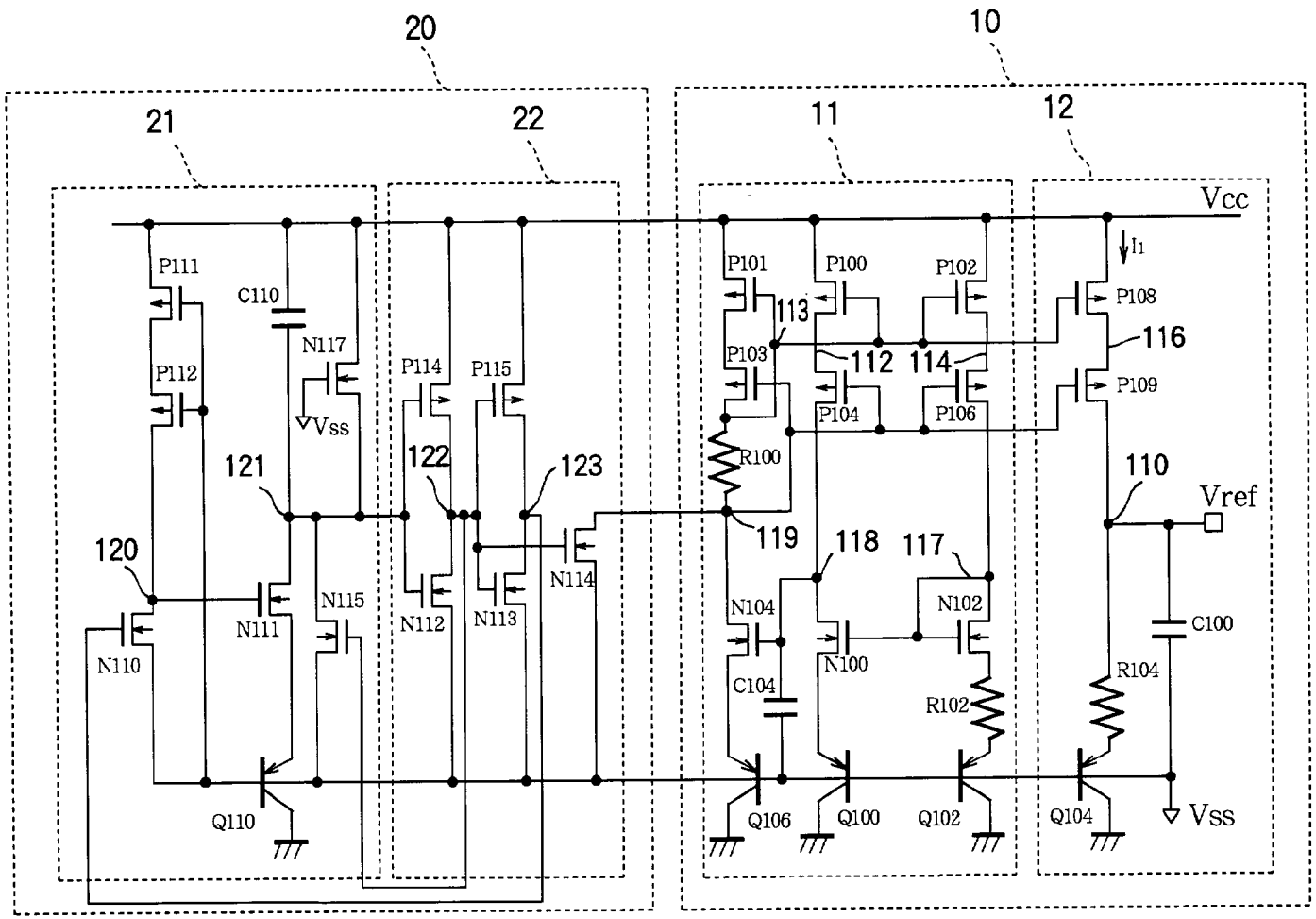
FIG. 16 is a circuit diagram of a bandgap reference voltage circuit illustrating a first variation of the fifth embodiment.

FIG. 16 is a circuit diagram of a bandgap reference voltage circuit illustrating a first variation of the fifth embodiment. In comparison with the circuit in FIG. 15, the reference stage 10 and the power supply voltage detection circuit 21 in the start-up stage 20 have the same configuration, while the start-up output circuit 22 has a different configuration. The start-up output circuit 22 has the same configuration as in the first variation of the second embodiment (see FIG. 6).

In the fifth embodiment, to start the constant-current circuit 11, the gate of n-channel transistor N104 is pulled up to the high power supply Vcc until Vcc reaches the voltage level VDSsatp111+VDSsatp112+Vbe110+Vtn111.

In the first variation of the fifth embodiment, the constant-current circuit 11 is started by pulling the common gate of p-channel transistors P104 and P106 down to the low power supply Vss. The common gate of transistors P100 and P102 is also pulled down to the low power supply Vss through resistor R100. By the time the pull-down operation ends, transistors N100, N102, and N104 have turned on and the high power supply Vcc has reached the VCC1 voltage level necessary for the cascode current mirror circuit comprising p-channel transistors P100, P102, P104, and P106 to operate correctly. The first variation has substantially the same effects as the fifth embodiment.

Second Variation of the Fifth Embodiment

Figure 17:
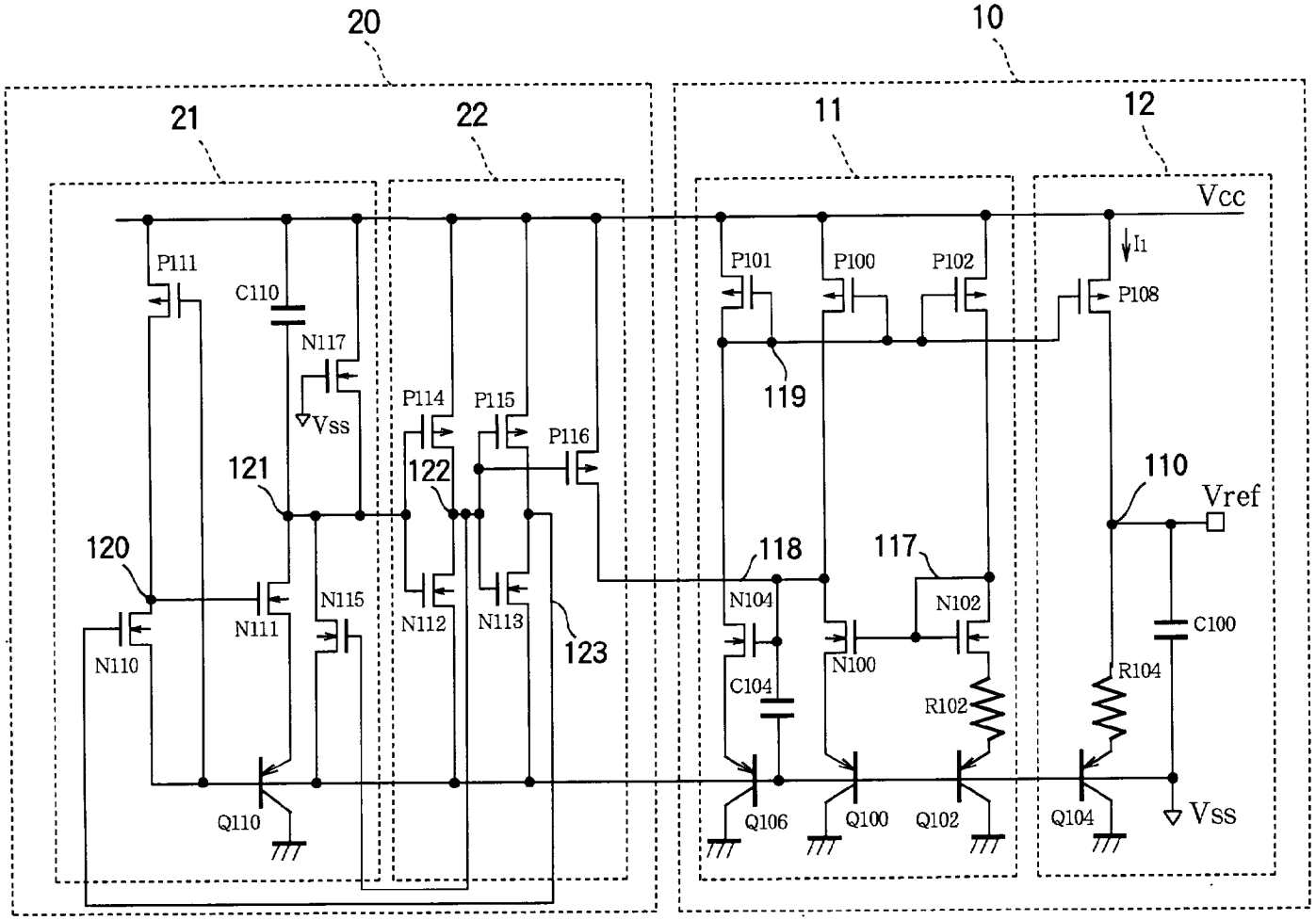
FIG. 17 is a circuit diagram of a bandgap reference voltage circuit illustrating a second variation of the fifth embodiment.

FIG. 17 is a circuit diagram of a bandgap reference voltage circuit illustrating a second variation of the fifth embodiment. In comparison with the circuit in FIG. 15, the start-up output circuit 22 in the start-up stage 20 has the same configuration while the reference stage 10 and the power supply voltage detection circuit 21 have different configurations. The reference stage 10 in this second variation has the same configuration as in the second variation of the third embodiment (see FIG. 11), while the power supply voltage detection circuit 21 in this second variation has the same configuration as in the second variation of the second embodiment (see FIG. 7).

Whereas the constant-current circuit 11 in the fifth embodiment had p-channel transistors connected in a cascode current mirror configuration, the second variation employs a simpler current mirror configuration.

In the second variation of the third embodiment, during power-up, the start-up stage 20 keeps the gate voltage of n-channel transistor N104 in the constant-current circuit 11 pulled up to the level of the high power supply Vcc until Vcc reaches the voltage level VDSsatp111+Vbe110+Vtn111. The constant-current circuit 11 starts up when the gate potential of transistor N104 reaches a level sufficient for transistor N104 to turn on.

The second variation of the third embodiment is applicable if the bandgap reference voltage circuit is fabricated by a process such that (VDSsatp+Vtn)>(VDSsatn+Vtp). The constant-current circuit 11 can then maintain constant-current operation if the high power supply Vcc is at least Vbe100+VDSsatp100+Vtn100. This is lower than the VCC1 value given by equation (3), making the second variation of the third embodiment useful for low-voltage applications.

Third Variation of the Fifth Embodiment

Figure 18:
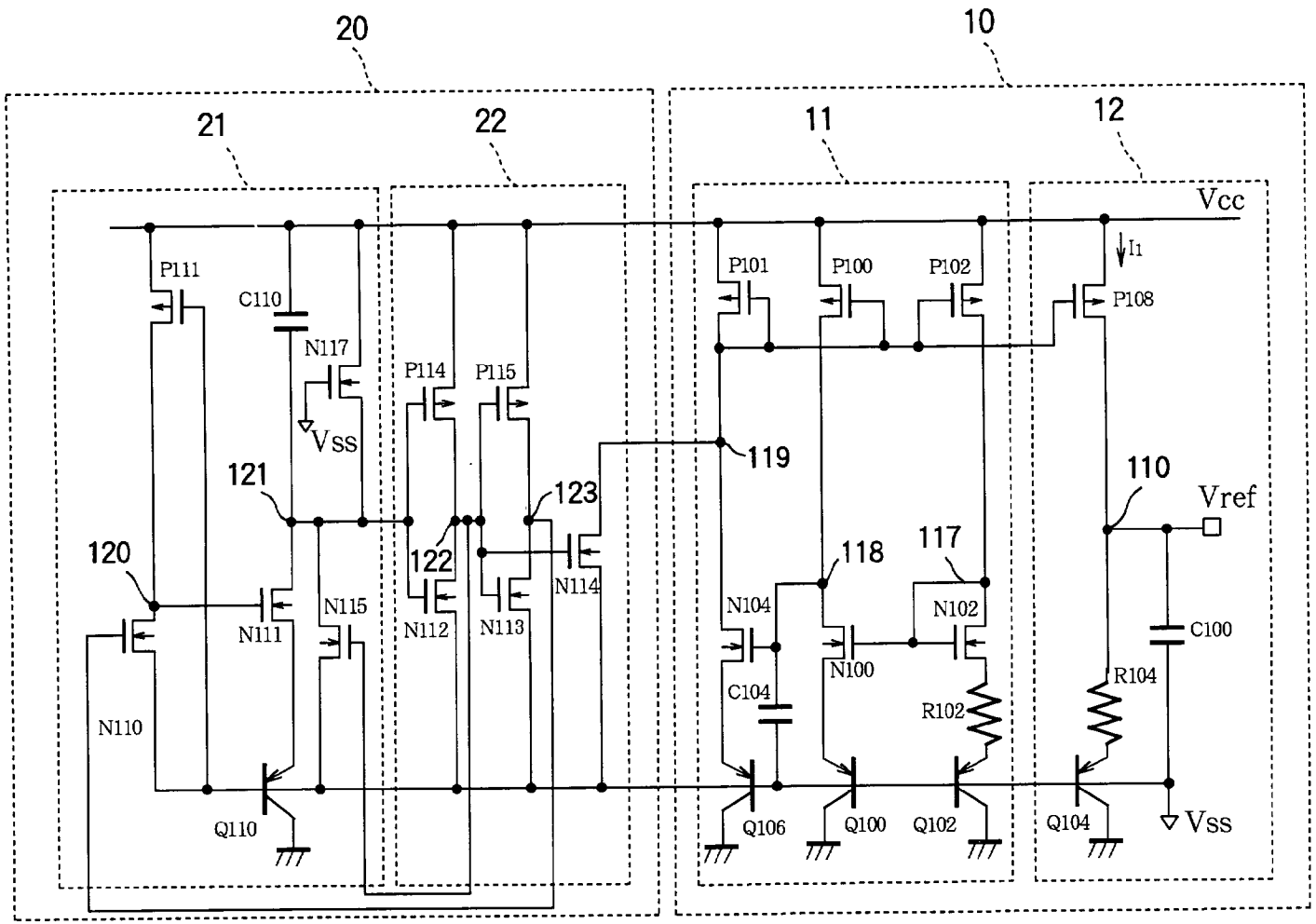
FIG. 18 is a circuit diagram of a bandgap reference voltage circuit illustrating a third variation of the fifth embodiment.

FIG. 18 is a circuit diagram of a bandgap reference voltage circuit illustrating a third variation of the fifth embodiment. The reference stage 10 and the power supply voltage detection circuit 21 of this circuit have the same configuration as in the second variation of the fifth embodiment, and the start-up output circuit 22 has the same configuration as in the first variation of the fifth embodiment.

In the start-up stage 20 of the third variation of the fifth embodiment, during power-up, the common gate of p-channel transistors P100 and P102 is kept pulled down to the level of the low power supply Vss until the high power supply Vcc reaches the voltage level VDSsatp111+Vbe110+Vtn111. P-channel transistors P100 and P102 therefore turn on quickly, enabling the constant-current circuit 11 to start up. This third variation has substantially the same effects as the second variation.

Sixth Embodiment

Figure 19:
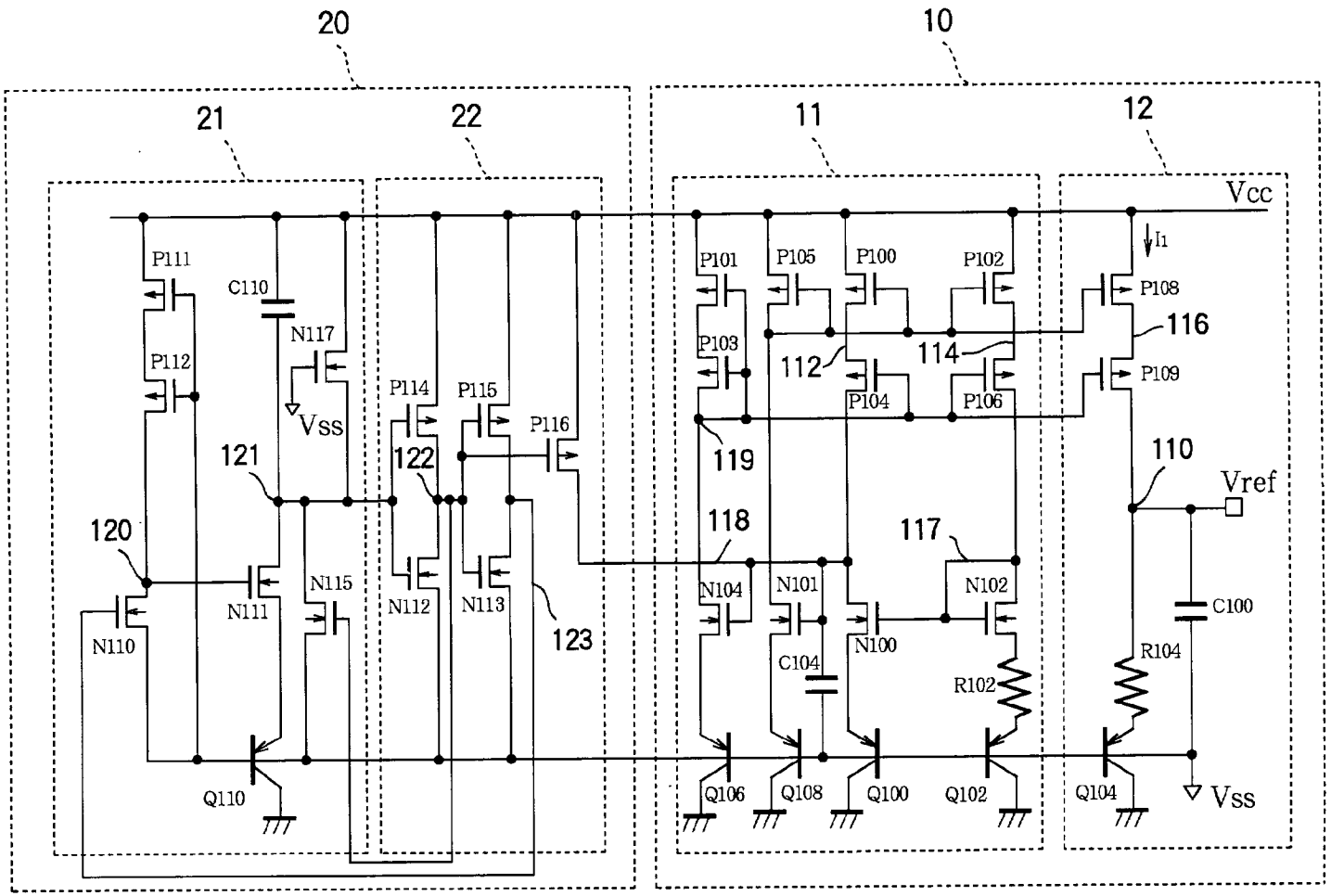
FIG. 19 is a circuit diagram of a bandgap reference voltage circuit illustrating a sixth embodiment of the invention.

FIG. 19 is a circuit diagram of a bandgap reference voltage circuit illustrating a sixth embodiment of the invention, comprising a reference stage 10 that has the same configuration as in the fourth embodiment, and a start-up stage 20 that has the same configuration as in the second embodiment.

Transistors P111 and P112, transistor N111, and transistor Q110 in the power supply voltage detection circuit 21 in FIG. 19 have the same specifications as transistors P100 and P104, transistor N100, and transistor Q100, respectively, in the constant-current circuit 11.

The reference stage 10 in the sixth embodiment operates in the same way as the reference stage 10 in the fourth embodiment (see FIG. 13), employing a negative feedback loop. The start-up stage 20 in the sixth embodiment operates in the same way as the start-up stage 20 in the second embodiment (see FIG. 5). During power-up, the common gate of n-channel transistors N101 and N104 in the constant-current circuit 11 is pulled up to the level of the high power supply Vcc until Vcc reaches the voltage level VDSsatp111+VDSsatp112+Vbe110+Vtn112, which is equal to the VCC1 value given by equation (3). This pull-up operation quickly turns on transistors N101 and N104, enabling the constant-current circuit 11 to start up. If the minimum high power supply voltage Vcc necessary for operation of the constant-current circuit 11 is the VCC1 value, then after the pull-up operation ends, the constant-current circuit 11 can continue operating on its own. The voltage at the starter node 118 changes from the pulled-up level, which is at least the sum of the source voltages of transistors N100 and N102 and the threshold voltage Vtn, to a steady-state voltage and is held steady by the negative feedback loop.

In the bandgap reference voltage circuit of the sixth embodiment, the start-up stage 20 has the same effects as in the second embodiment, and the constant-current circuit 11 has the same effects as in the fourth embodiment.

Variation of the Sixth Embodiment

Figure 20:
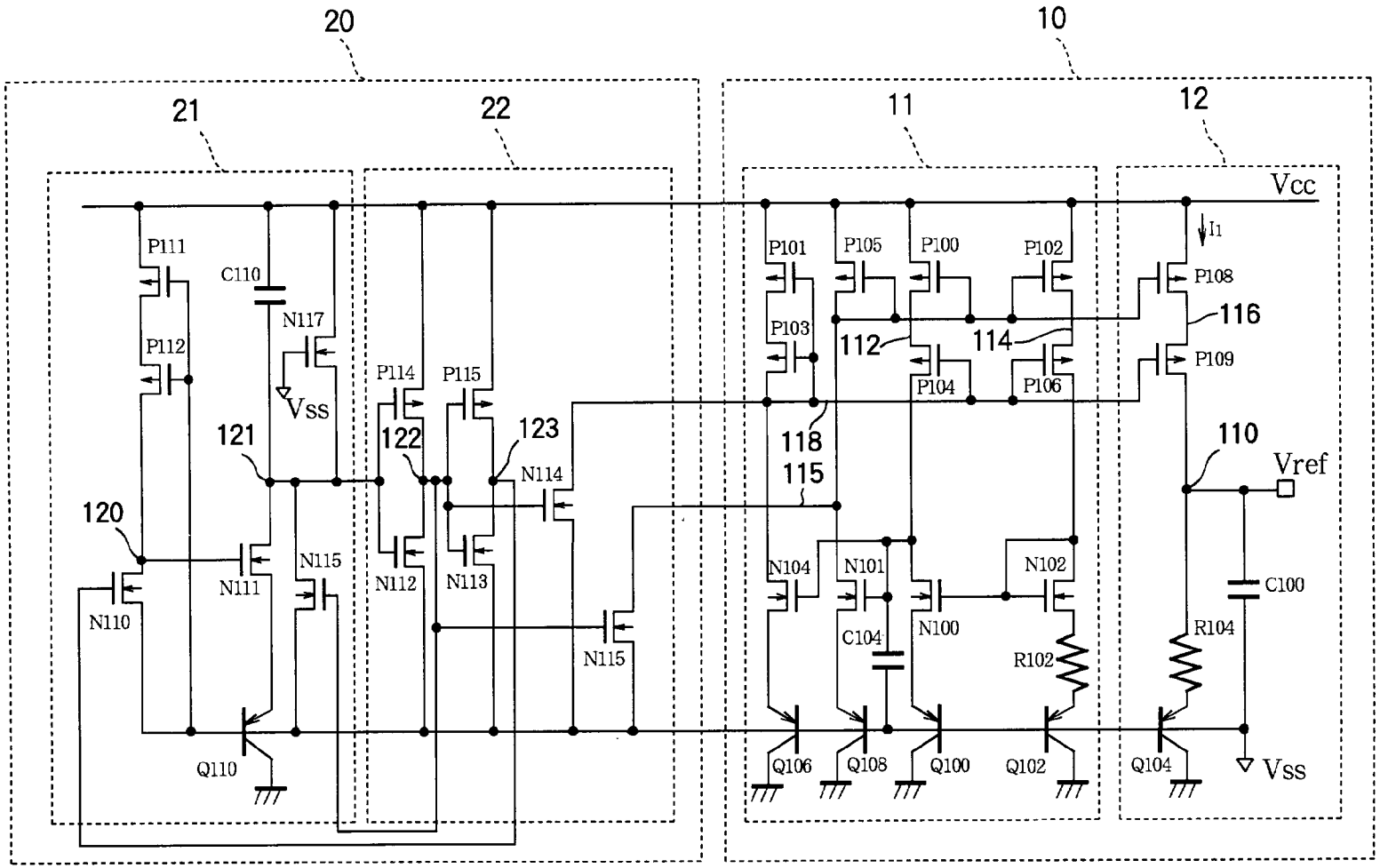
FIG. 20 is a circuit diagram of a bandgap reference voltage circuit illustrating a variation of the sixth embodiment.

FIG. 20 is a circuit diagram of a bandgap reference voltage circuit illustrating a variation of the sixth embodiment. In comparison with the circuit in FIG. 19, the reference stage 10 and the power supply voltage detection circuit 21 in the start-up stage 20 have the same configuration, while the start-up output circuit 22 has a different configuration. The start-up output circuit 22 has the same configuration as the start-up output circuit 22 in the first variation of the fourth embodiment (see FIG. 14).

The start-up output circuit 22 in FIG. 20 differs from the start-up output circuit 22 in FIG. 19 in having two n-channel start-up transistors N114 and N115, instead of a single p-channel start-up transistor P116. Transistor N114 has a gate coupled to node 122, a source coupled to the low power supply Vss, and a drain coupled to node 119, which is now the starter node in the constant-current circuit 11. Transistor N115 has a gate coupled to node 122, a source coupled to the low power supply Vss, and a drain coupled to a node 115, which is another starter node in the constant-current circuit 11.

In the sixth embodiment, during power-up, the common gate of n-channel transistors N101 and N104 in the constant-current circuit 11 is pulled up to the level of the high power supply Vcc until the high power supply Vcc reaches the voltage level VDSsatp111+Vbe110+Vtn111, so that transistors N101 and N104 turn on quickly, enabling the constant-current circuit 11 to start up.

In the variation of the sixth embodiment, during power-up, the common gate of p-channel transistors P104 and P106 is pulled down to the level of the low power supply Vss, and the common gate of transistors P100 and P102 is also pulled down to the Vss level. As a result, the cascode current mirror circuit comprising p-channel transistors P100, P102, P104, and P106 operates in a way that quickly turns on n-channel transistors N100, N101, N102, and N104, starting up the constant-current circuit 11. This variation has substantially the same effects as the sixth embodiment.

In addition to the variations of the embodiments described above, those skilled in the art will recognize that further variations are possible within the scope of the appended claims.

What is claimed is:

1. A bandgap reference voltage circuit, comprising:

a constant-current circuit receiving a power supply and generating a constant current proportional to a thermal voltage, having first circuit elements defining a lower limit voltage equal to a lowest voltage of the power supply at which the constant-current circuit can operate, and having a starter node controlling a flow of said constant current;

a reference voltage output circuit connected to the constant-current circuit, generating a bandgap reference voltage according to said constant current;

a power supply voltage detection circuit receiving the power supply, having second circuit elements having electrical characteristics corresponding to electrical characteristics of the first circuit elements in the constant-current circuit, using the second circuit elements to detect whether the power supply has reached the lower limit voltage; and a start-up output circuit connected to the power supply voltage detection circuit, for starting the constant-current circuit, when the power supply is turned on, by supplying a starting potential to the starter node until the power supply has reached the lower limit voltage, then ceasing to supply the starting potential to the starter node, wherein the first circuit elements in the constant-current circuit include a pair of p-channel metal-oxide-semiconductor (MOS) transistors, an n-channel MOS transistor, and a bipolar transistor, the lower limit voltage being defined by a saturation source-drain voltage of one of the p-channel MOS transistors, a threshold voltage of another one of the p-channel MOS transistors, a saturation source-drain voltage of the n-channel MOS transistor, and a base-emitter voltage of the bipolar transistor, and the second circuit elements in the power supply voltage detection circuit include a corresponding pair of p-channel MOS transistors, a corresponding n-channel MOS transistor, and a corresponding bipolar transistor, and wherein the corresponding n-channel MOS transistor, the corresponding bipolar transistor, and one of the corresponding p-channel MOS transistors of the second circuit elements are coupled in series on a detection path conducting current from the power supply, and the other one of the corresponding p-channel MOS transistors has a gate coupled to the detection path, a source coupled to the power supply, and a drain coupled to the start-up output circuit.

2. The bandgap reference voltage circuit of claim 1, wherein the power supply voltage detection circuit also includes:

a capacitor coupled to the drain of said other one of the corresponding p-channel MOS transistors; and a path-blocking switching element inserted in the detection path and controlled by the start-up output circuit, for interrupting the detection path when the start-up output circuit ceases to supply the starting potential to the starter node.

3. A bandgap reference voltage circuit, comprising:

a constant-current circuit receiving a power supply and generating a constant current proportional to a thermal voltage, having first circuit elements defining a lower limit voltage equal to a lowest voltage of the power supply at which the constant-current circuit can operate, and having a starter node controlling a flow of said constant current;

a reference voltage output circuit connected to the constant-current circuit, generating a bandgap reference voltage according to said constant current;

a power supply voltage detection circuit receiving the power supply, having second circuit elements having electrical characteristics corresponding to electrical characteristics of the first circuit elements in the constant-current circuit, using the second circuit elements to detect whether the power supply has reached the lower limit voltage; and a start-up output circuit connected to the power supply voltage detection circuit, for starting the constant-current circuit, when the power supply is turned on, by supplying a starting potential to the starter node until the power supply has reached the lower limit voltage, then ceasing to supply the starting potential to the starter node, wherein the first circuit elements in the constant-current circuit include a p-channel MOS transistor, an n-channel MOS transistor, and a bipolar transistor, the lower limit voltage being defined by a threshold voltage of the p-channel MOS transistor, a saturation source-drain voltage of the n-channel MOS transistor, and a base-emitter voltage of the bipolar transistor, and the second circuit elements in the power supply voltage detection circuit include a corresponding p-channel MOS transistor, a corresponding n-channel MOS transistor, and a corresponding bipolar transistor.

4. The bandgap reference voltage circuit of claim 3, wherein the corresponding n-channel MOS transistor and the corresponding bipolar transistor of the second circuit elements are coupled in series on a detection path conducting current from the power supply, and the corresponding p-channel MOS transistor has a gate coupled to the detection path, a source to coupled to the power supply, and a drain coupled to the start-up output circuit.

5. The bandgap reference voltage circuit of claim 4, wherein the power supply voltage detection circuit also includes:

a capacitor coupled to the drain of said corresponding p-channel MOS transistor; and a path-blocking switching element inserted in the detection path and controlled by the start-up output circuit, for interrupting the detection path when the start-up output circuit ceases to supply the starting potential to the starter node.

6. A bandgap reference voltage circuit, comprising:

a constant-current circuit receiving a power supply and generating a constant current proportional to a thermal voltage, having first circuit elements defining a lower limit voltage equal to a lowest voltage of the power supply at which the constant-current circuit can operate, and having a starter node controlling a flow of said constant current;

a reference voltage output circuit connected to the constant-current circuit, generating a bandgap reference voltage according to said constant current;

a power supply voltage detection circuit receiving the power supply, having second circuit elements having electrical characteristics corresponding to electrical characteristics of the first circuit elements in the constant-current circuit, using the second circuit elements to detect whether the power supply has reached the lower limit voltage; and a start-up output circuit connected to the power supply voltage detection circuit, for starting the constant-current circuit, when the power supply is turned on, by supplying a starting potential to the starter node until the power supply has reached the lower limit voltage, then ceasing to supply the starting potential to the starter node, wherein the first circuit elements in the constant-current circuit include a pair of p-channel MOS transistors, an n-channel MOS transistor, and a bipolar transistor, the lower limit voltage being defined by saturation source-drain voltages of the pair of p-channel MOS transistors, a threshold voltage of the n-channel MOS transistor, and a base-emitter voltage of the bipolar transistor, and the second circuit elements in the power supply voltage detection circuit include a corresponding pair of p-channel MOS transistors, a corresponding n-channel MOS transistor, and a corresponding bipolar transistor, and wherein the corresponding pair of p-channel MOS transistors of the second circuit elements are coupled in series on a detection path conducting current from the power supply, and the corresponding n-channel MOS transistor and the corresponding bipolar transistor of the second circuit elements are coupled in series, the corresponding n-channel MOS transistor having a gate coupled the detection path, a source coupled to the corresponding bipolar transistor, and a drain coupled to the start-up output circuit, the corresponding bipolar transistor being grounded.

7. The bandgap reference voltage circuit of claim 6, wherein the power supply voltage detection circuit also includes:

a capacitor coupled to the drain of said corresponding n-channel MOS transistor; and a path-blocking switching element inserted in the detection path and controlled by the start-up output circuit, for interrupting the detection path when the start-up output circuit ceases to supply the starting potential to the starter node.

8. A bandgap reference voltage circuit, comprising:

a constant-current circuit receiving a power supply and generating a constant current proportional to a thermal voltage, having first circuit elements defining a lower limit voltage equal to a lowest voltage of the power supply at which the constant-current circuit can operate, and having a starter node controlling a flow of said constant current;

a reference voltage output circuit connected to the constant-current circuit, generating a bandgap reference voltage according to said constant current;

a power supply voltage detection circuit receiving the power supply, having second circuit elements having electrical characteristics corresponding to electrical characteristics of the first circuit elements in the constant-current circuit, using the second circuit elements to detect whether the power supply has reached the lower limit voltage; and a start-up output circuit connected to the power supply voltage detection circuit, for starting the constant-current circuit, when the power supply is turned on, by supplying a starting potential to the starter node until the power supply has reached the lower limit voltage, then ceasing to supply the starting potential to the starter node, wherein the first circuit elements in the constant-current circuit include a p-channel MOS transistor, an n-channel MOS transistor, and a bipolar transistor, the lower limit voltage being defined by a saturation source-drain voltage of the p-channel MOS transistor, a threshold voltage of the n-channel MOS transistor, and a base-emitter voltage of the bipolar transistor, and the second circuit elements in the power supply voltage detection circuit include a corresponding p-channel MOS transistor, a corresponding n-channel MOS transistor, and a corresponding bipolar transistor, and wherein the corresponding p-channel MOS transistor of the second circuit elements is disposed on a detection path conducting current from the power supply, and the corresponding n-channel MOS transistor and the corresponding bipolar transistor of the second circuit elements are coupled in series, the corresponding n-channel MOS transistor having a gate coupled to the detection path, a source coupled to the corresponding bipolar transistor, and a drain coupled to the start-up output circuit, the corresponding bipolar transistor being grounded.

9. The bandgap reference voltage circuit of claim 8, wherein the power supply voltage detection circuit also includes:

a capacitor coupled to the drain of said corresponding n-channel MOS transistor; and a path-blocking switching element inserted in the detection path and controlled by the start-up output circuit, for interrupting the detection path when the start-up output circuit ceases to supply the starting potential to the starter node.

* * * * *